US010962229B2

(12) United States Patent
Park et al.

(10) Patent No.: US 10,962,229 B2
(45) Date of Patent: Mar. 30, 2021

(54) COOKING APPLIANCE

(71) Applicant: LG ELECTRONICS INC., Seoul (KR)

(72) Inventors: Hyun Woo Park, Seoul (KR); Jun Ho Seok, Seoul (KR); Jong Ho Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 290 days.

(21) Appl. No.: 16/017,263

(22) Filed: Jun. 25, 2018

(65) Prior Publication Data

US 2019/0003717 A1 Jan. 3, 2019

(30) Foreign Application Priority Data

Jun. 30, 2017 (KR) ..... 10-2017-0083902

(51) Int. Cl.
*F24C 7/06* (2006.01)
*F24C 15/00* (2006.01)
(Continued)

(52) U.S. Cl.
CPC ..... *F24C 7/062* (2013.01); *F24C 7/06* (2013.01); *F24C 7/081* (2013.01); *F24C 15/002* (2013.01);
(Continued)

(58) Field of Classification Search
CPC .. F24C 3/08; F24C 3/085; F24C 3/006; F24C 3/02; F24C 3/082; F24C 3/10;
(Continued)

(56) References Cited

U.S. PATENT DOCUMENTS 1,431,953 A 10/1922 Henoch
2,798,930 A * 7/1957 Frost ..... F24C 7/06 219/392
(Continued)

FOREIGN PATENT DOCUMENTS

CH 703 729 2/2012
DE 297 03 147 4/1997
(Continued)

OTHER PUBLICATIONS

European Search Report dated Nov. 15, 2018 issued in EP Application No. 18180283.6.
(Continued)

*Primary Examiner* — Ibrahime A Abraham
*Assistant Examiner* — William C. Gibson
(74) *Attorney, Agent, or Firm* — KED & Associates LLP

(57) ABSTRACT

A cooking appliance is provided that may include a main body having a cooking chamber formed therein; a lower space formed inside the main body and separated from the cooking chamber between a bottom of the main body and the cooking chamber; and first and second heating assemblies, the second heating assembly being installed inside the lower space. An opening configured to open the lower space portion to an outside of the main body may be formed in the lower space between the bottom of the main body and the cooking chamber, and the second heating assembly may be inserted into or withdrawn from the lower space through the opening.

15 Claims, 22 Drawing Sheets

(51) Int. Cl.

| | |
|---|---|
| ***F24C 15/04*** | (2006.01) |
| ***F24C 15/32*** | (2006.01) |
| ***F24C 7/08*** | (2006.01) |
| ***F24C 15/18*** | (2006.01) |

(52) U.S. Cl.
CPC ..... *F24C 15/04* (2013.01); *F24C 15/18* (2013.01); *F24C 15/32* (2013.01); *F24C 15/325* (2013.01)

(58) Field of Classification Search
CPC .. F24C 3/103; F24C 3/12; F24C 3/022; F24C 3/042; F24C 3/087; F24C 3/122; F24C 15/107; F24C 15/001; F24C 15/101; F24C 15/08; F24C 15/18; F24C 15/2042; F24C 15/32; F24C 1/04; F24C 3/002; F23D 14/70; F23D 14/14; F23D 14/26; F23D 14/045; F23D 14/16; F23D 2203/102; F23D 2203/1026; F23D 2207/00; F23D 2900/11401; F24B 1/207; F24B 1/26; F24B 5/023; F23L 1/00; F23L 5/02; F23L 9/02; A47J 37/0713; A47J 37/0727; A47J 37/074; A47J 37/0786; A47J 37/0754
USPC ..... 219/396, 395, 400, 486, 393, 391, 402, 219/403, 405, 407, 462.1, 390, 408, 409, 219/410, 433, 452.12, 417, 436, 453.11, 219/460.1, 525, 538, 681, 685, 756, 762, 219/21 A, 21 R, 19 R, 273 R, 337 R; 126/21 A, 21 R, 19 R, 273 R, 337 R, 339, 126/39 B, 50, 9 R; 99/474, 328, 329 R, 99/375, 391, 425, 444; 432/258
See application file for complete search history.

(56) References Cited

U.S. PATENT DOCUMENTS

| | | | | |
|---|---|---|---|---|
| 3,828,760 | A | 8/1974 | Farber | |
| 3,889,581 | A | 6/1975 | Bray, Sr. | |
| 4,108,139 | A | 8/1978 | Gillionn | |
| 4,144,870 | A * | 3/1979 | Reynolds | A47J 37/06 126/41 E |
| 4,354,084 | A | 10/1982 | Husslein et al. | |
| 4,516,012 | A | 5/1985 | Smith | |
| 4,601,279 | A | 7/1986 | Guerin | |
| 4,829,158 | A * | 5/1989 | Burnham | F24C 15/325 126/21 A |
| 4,964,392 | A * | 10/1990 | Bruno | A21B 1/48 126/21 A |
| 5,361,749 | A | 11/1994 | Smith, Jr. | |
| 5,460,157 | A | 10/1995 | Prabhu | |
| 5,492,055 | A | 2/1996 | Nevin | |
| 5,655,511 | A | 8/1997 | Prabhu | |
| 5,816,234 | A | 10/1998 | Vasan | |
| 6,124,572 | A * | 9/2000 | Spilger | A47B 88/49 219/394 |
| 6,307,185 | B1 | 10/2001 | Loveless | |
| 7,060,940 | B2 | 6/2006 | Kim | |
| 7,372,000 | B2 | 5/2008 | Stockley | |
| 8,709,905 | B2 | 4/2014 | Crayfourd | |
| 9,404,660 | B1 | 8/2016 | Karabin | |
| 9,939,161 | B2 * | 4/2018 | Jeong | F24C 15/322 |
| 2002/0092842 | A1 | 7/2002 | Loveless | |
| 2004/0129692 | A1 | 7/2004 | Kim | |
| 2006/0131298 | A1 | 6/2006 | Seuk Oh | |
| 2007/0108179 | A1 | 5/2007 | Hines, Jr. | |
| 2007/0131220 | A1 | 6/2007 | Kim | |
| 2007/0295706 | A1 | 12/2007 | Brun | |
| 2008/0223843 | A1 | 9/2008 | White | |
| 2009/0065493 | A1 | 3/2009 | Hines, Jr. | |
| 2011/0049124 | A1 | 3/2011 | Crayfourd | |
| 2012/0080419 | A1 | 4/2012 | Bush | |
| 2013/0255655 | A1 | 10/2013 | Johnson | |
| 2013/0323663 | A1 * | 12/2013 | Harward | A47J 39/02 432/247 |
| 2014/0137853 | A1 | 5/2014 | Murray | |
| 2014/0283814 | A1 | 9/2014 | Armstrong | |
| 2016/0003384 | A1 | 1/2016 | Fischer | |
| 2016/0204676 | A1 | 7/2016 | Ziegler | |
| 2016/0320072 | A1 | 11/2016 | Colozzo et al. | |
| 2017/0118798 | A1 | 4/2017 | Johnson et al. | |
| 2017/0292713 | A1 | 10/2017 | Boedicker | |
| 2018/0184488 | A1 | 6/2018 | Lee | |
| 2018/0347828 | A1 | 12/2018 | Seok | |

FOREIGN PATENT DOCUMENTS

| | | | |
|---|---|---|---|
| DE | 203 21 203 | 6/2006 | |
| EP | 0 628 772 | 12/1994 | |
| EP | 0 860 658 | 8/1998 | |
| EP | 1 312 293 | 5/2003 | |
| EP | 1 674 796 | 6/2006 | |
| EP | 2 610 557 | 7/2013 | |
| FR | 2653209 | 4/1991 | |
| GB | 1183203 | 3/1970 | |
| KR | 20-1998-0029343 | 8/1998 | |
| KR | 10-2006-0070910 | 6/2006 | |
| KR | 20060070910 A * | 6/2006 | F24C 15/325 |
| KR | 10-2016-0084273 | 7/2016 | |
| WO | WO 2008/112855 | 9/2008 | |
| WO | WO 2015/092640 | 6/2015 | |

OTHER PUBLICATIONS

European Search Report dated Nov. 19, 2018 issued in EP Application No. 18180284.4.
European Search Report dated Nov. 21, 2018 issued in EP Application No. 18180288.5.
Korean Notice of Allowance dated Aug. 27, 2018 issued in Application No. 10-2017-0083902.
Korean Notice of Allowance dated Aug. 28, 2018 issued in Application No. 10-2017-0083901.
European Office Action dated Oct. 16, 2019 issued in Application No. 18 180 283.6.
United States Office Action dated Jul. 20, 2020 issued in U.S. Appl. No. 16/017,446.

* cited by examiner

COOKING APPLIANCE

CROSS-REFERENCE TO RELATED APPLICATION(S)

This application claims priority to and the benefit of Korean Patent Application No. 10-2017-0083902, filed on Jun. 30, 2017, the disclosure of which is incorporated herein by reference in its entirety.

BACKGROUND

1. Field

A cooking appliance is disclosed herein.

2. Background

A cooking appliance may be a household appliance used to cooking food or other items (hereinafter "food"), and may be installed in a space in a kitchen to cook food according to a user's intention. Such a cooking appliance may be classified into one of various types of cooking appliances depending on a heating source, a shape, or a fuel type to be used.

For example, a cooking appliance may be classified into an open-type cooking appliance and a sealed-type cooking appliance depending on a shape in which food is cooking, that is, a shape of a space where food is placed. Sealed-type cooking appliances may include an oven, a microwave oven, and the like, and open-type cooking appliances may include a cooktop, a hob, and the like.

A sealed-type cooking appliance may shield a space where food is placed and may cook food by heating the shielded space. The sealed-type cooking appliance a cooking chamber, which is a space to be shielded when food is placed and cooked therein. Such a cooking chamber may then become a space where food is substantially cooked.

A door configured to selectively open and close the cooking chamber may be rotatably provided in a sealed-type cooking appliance. The door may be rotatably installed on the main body by a door hinge provided between the main body having the cooking chamber formed therein and the door. That is, the door may selectively open and close the cooking chamber by being rotated around a portion coupled to the main body by the door hinge.

A heating source may be provided in an inner space of the cooking chamber, which is opened and closed by the door, to heat the cooking chamber. A gas burner, an electric heater, or the like may be used as the heating source.

In a sealed-type cooking appliance in which a gas burner is used as a heating source, a plurality of burners may be provided to heat food inside the cooking chamber. For example, a broil burner may be installed on or at an upper portion of cooking chamber, and a bake burner may be installed on a lower portion or at a rear of the cooking chamber.

Also, a convection device may be further provided at the rear of the cooking chamber. The convection device may circulate air inside the cooking chamber so that heat is uniformly distributed throughout the cooking chamber, and may include a fan cover installed on a rear wall of the cooking chamber and a convection fan installed in an inner space of the fan cover.

A suction port and a discharge port may be provided inside the fan cover, the suction port may be formed in the center of a front surface the fan cover facing the door, and the discharge port may be formed in a side surface of the fan cover facing a side surface of the cooking chamber. The convection fan may be rotated inside the fan cover to generate airflow. Accordingly, the convection fan may generate an air circulation flow so that the air in the cooking chamber is introduced into the fan cover through the suction port and the air heated inside the fan cover is discharged to the cooking chamber through the discharge port.

The bake burner may be divided into a probake burner and a bottom bake burner depending on the installation form thereof. The probake burner may be installed behind the cooking chamber and inside the convection device. In the cooking appliance in which such a probake burner is installed, heat may be generated inside the convection device by the combustion of the probake burner, and the generated heat may be circulated inside a fan cover and may be evenly distributed throughout the cooking chamber by an operation of a convection fan that generates airflow.

Compared to the probake type cooking appliance, a bottom bake burner may be installed under the cooking chamber. The cooking appliance in which the bottom bake burner is installed may have an advantage of implementing a function of applying concentrated heating to a bottom surface of food by allowing heat generated in the bottom bake burner to be transferred to a lower portion of the food in the cooking chamber.

The bottom bake burner may be installed below the cooking chamber and in a separate installation space separately provided below the cooking chamber, and the bottom surface of the cooking chamber may partition the space where the bottom bake burner is installed and the cooking chamber. The bottom bake burner may require a path through which the bottom bake burner can be drawn out from the installation space for maintenance. In order to provide the path, a method of configuring a bottom surface of a cooking chamber that partitions the cooking chamber and a bottom bake burner installation space with a plate which is detachable from a main body of a cooking appliance, or a method of configuring a main body of a cooking appliance in a form in which a lower portion of a bottom bake burner installation space is open, is generally used.

However, when the bottom surface of the cooking chamber is configured to use the plate which is detachable from the main body of the cooking appliance, a gap may be formed between the plate configured to form the bottom surface of the cooking chamber and a part connecting the plate and the main body. As a result, the bottom surface of the cooking chamber may not be smoothly connected to the main body, which may negatively affect the aesthetic appearance inside the cooking appliance and may not be good for cleanliness because foreign substances may collect in the gap.

When the lower portion of the bottom bake burner installation space of the main body of the cooking appliance is configured to open in order to form a smooth cooking chamber bottom, the main body of the cooking appliance may need to be turned over to perform maintenance work on the bottom bake burner, which causes the maintenance work for the bottom bake burner to become very difficult.

BRIEF DESCRIPTION OF THE DRAWINGS

Embodiments will be described in detail with reference to the following drawings in which like reference numerals refer to like elements, and wherein.

DETAILED DESCRIPTION

Figure 1:
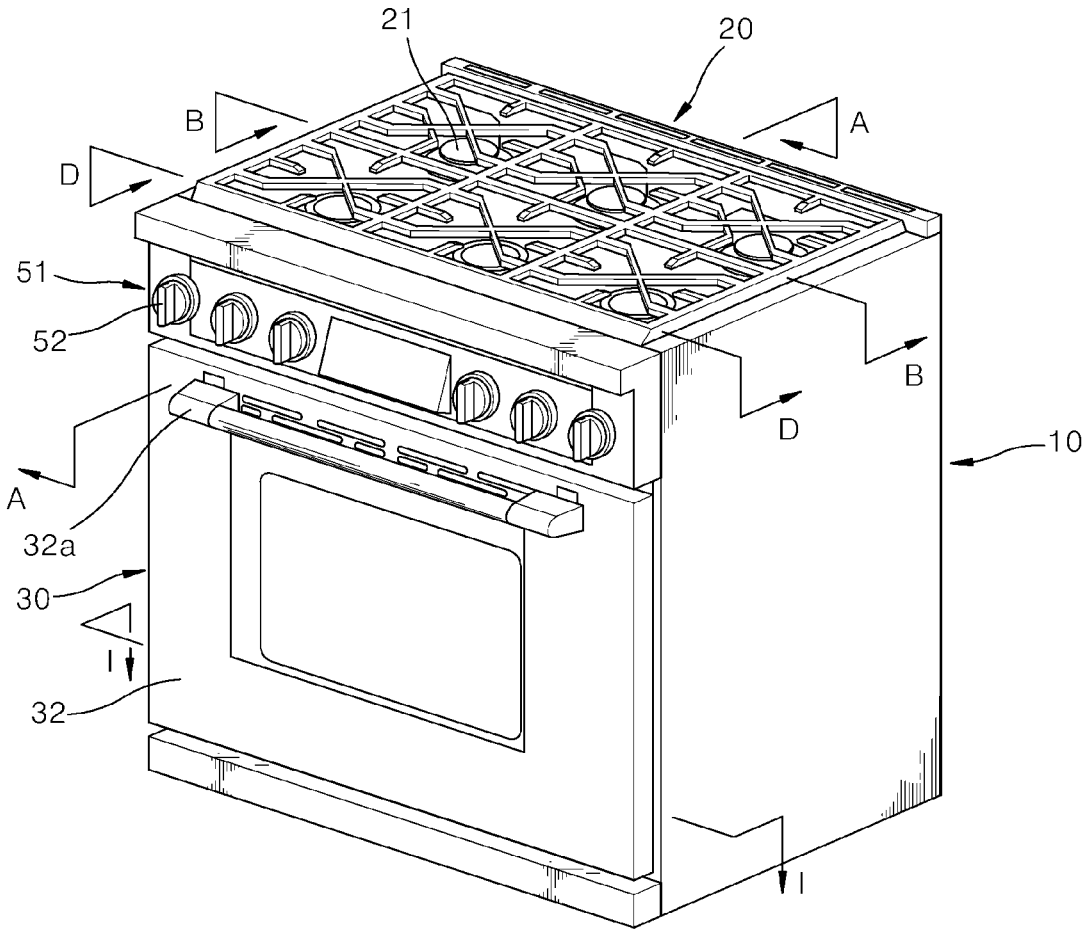
FIG. 1 is a perspective view schematically illustrating a cooking appliance according to an embodiment.

Hereinafter, an embodiment of a cooking appliance according to embodiments will be described with reference to the accompanying drawings. For clarity and convenience of explanation, thicknesses of lines and sizes of components shown in the drawings may be exaggerated. In addition, the terms described below are defined in consideration of functions, which may vary depending on the intention of a user or operator, or custom. Therefore, the definitions of these terms should be based on the contents throughout this specification.

Figure 2:
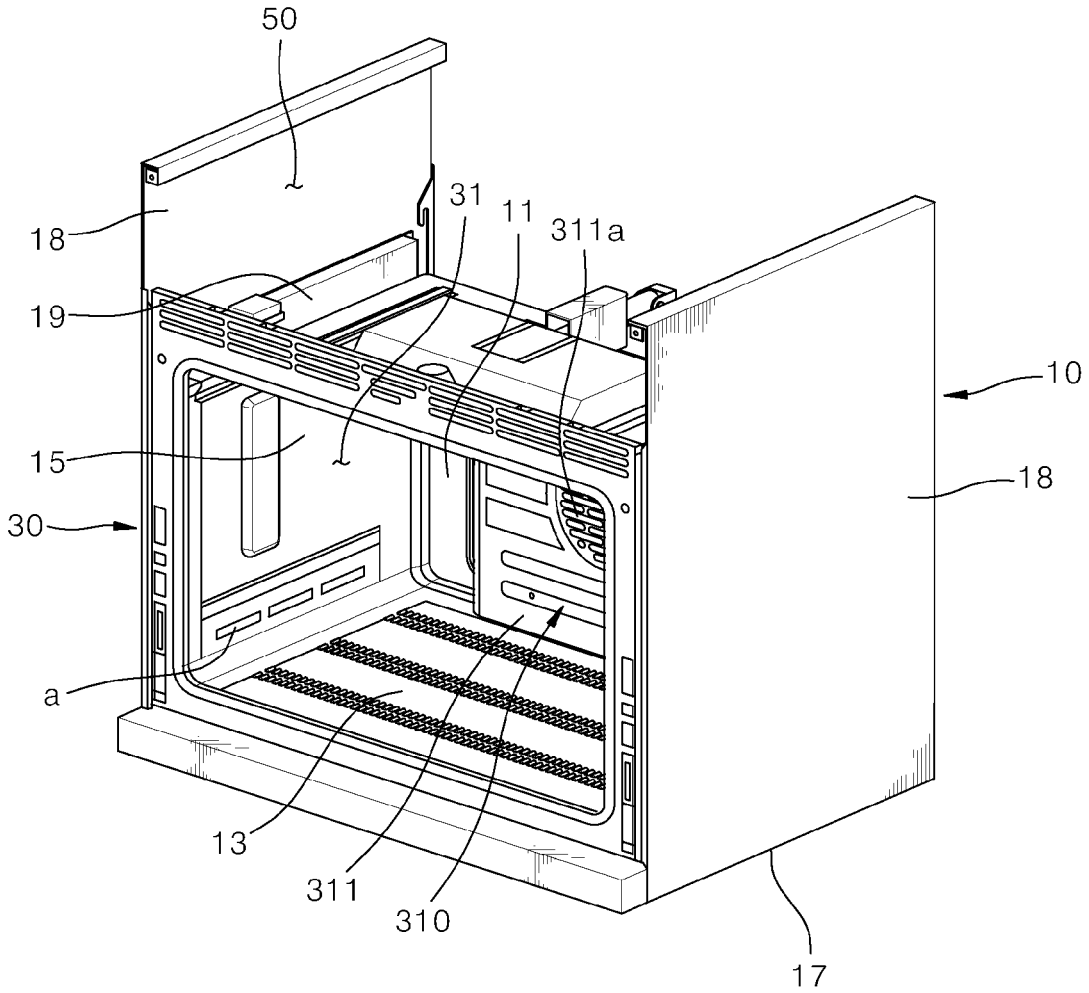
FIG. 2 is a perspective view illustrating an oven separated from the cooking appliance illustrated in FIG. 1.

FIG. 1 is a perspective view illustrating a cooking appliance according to an embodiment. FIG. 2 is a perspective view illustrating an oven of the cooking appliance illustrated in FIG. 1.

Referring to FIGS. 1 and 2, an exterior of the cooking appliance according to an embodiment may be formed by a main body 10 of the cooking appliance. The main body 10 may be approximately rectangular shaped and may be formed of a material having a predetermined strength to protect a plurality of parts installed inside the main body 10.

A cooktop unit (or cooktop) 20 may be provided on an upper end portion of the main body 10, and food or a container filled with food placed thereon may be heated by the cooktop 20 to cook the food. At least one cooktop heater 21 configured to heat food or a container filled with food to be cooked may be provided in or on the cooktop 20.

An oven unit (or oven) 30 may be installed under the cooktop 20. A cooking chamber 31 may be provided inside the oven 30 to provide a space where food is cooked. The cooking chamber 31 may be formed in a hexahedral shape of which a front surface is open, and the inner space of the cooking chamber 31 may be heated to cook the food while the cooking chamber 31 is shielded. That is, the inner space of the cooking chamber 31 may be a space in which the food is actually cooked in the oven 30.

A door 32 that selectively opens and closes the cooking chamber 31 may be rotatably provided on or at the oven 30. The door 32 may open and close the cooking chamber 31 in a pull-down manner in which an upper end thereof is rotated up and down around a lower end thereof.

The door 32 may be entirely formed in a hexahedral shape having a predetermined thickness, and a handle 32*a* may be installed on a front surface of the door 32 so that a user may grip the handle 32*a* to rotate the door 32. The user may easily rotate the door using the handle 32*a*.

A control panel 51 may be provided at a front surface of the cooktop 20 and above the door 32. The control panel 51 may be formed in a hexahedral shape having a predetermined inner space, and an input unit (or input) 52 may be provided on a front surface of the control panel 51 for the user to input operating signals for operating the cooktop 20 and the oven 30. A plurality of operational switches may be provided in or at the input 52 and the user may directly input operating signals using the operational switches.

Also, the control panel 51 may further include a display part (or display) to provide the user with information on the operation of the cooking appliance or information on food being cooked, and thus the user may check various types of information on a shelf supporter and the cooking appliance including the shelf supporter through the display unit. A machine room 50 configured to provide a space in which electrical components are located may be formed inside the main body 10, that is, in a space between the cooktop 20 and the oven 30. The control panel 51 may be provided on a front surface of the machine room 50 so that the control panel 51 substantially covers the front surface of the machine room 50.

Figure 3:
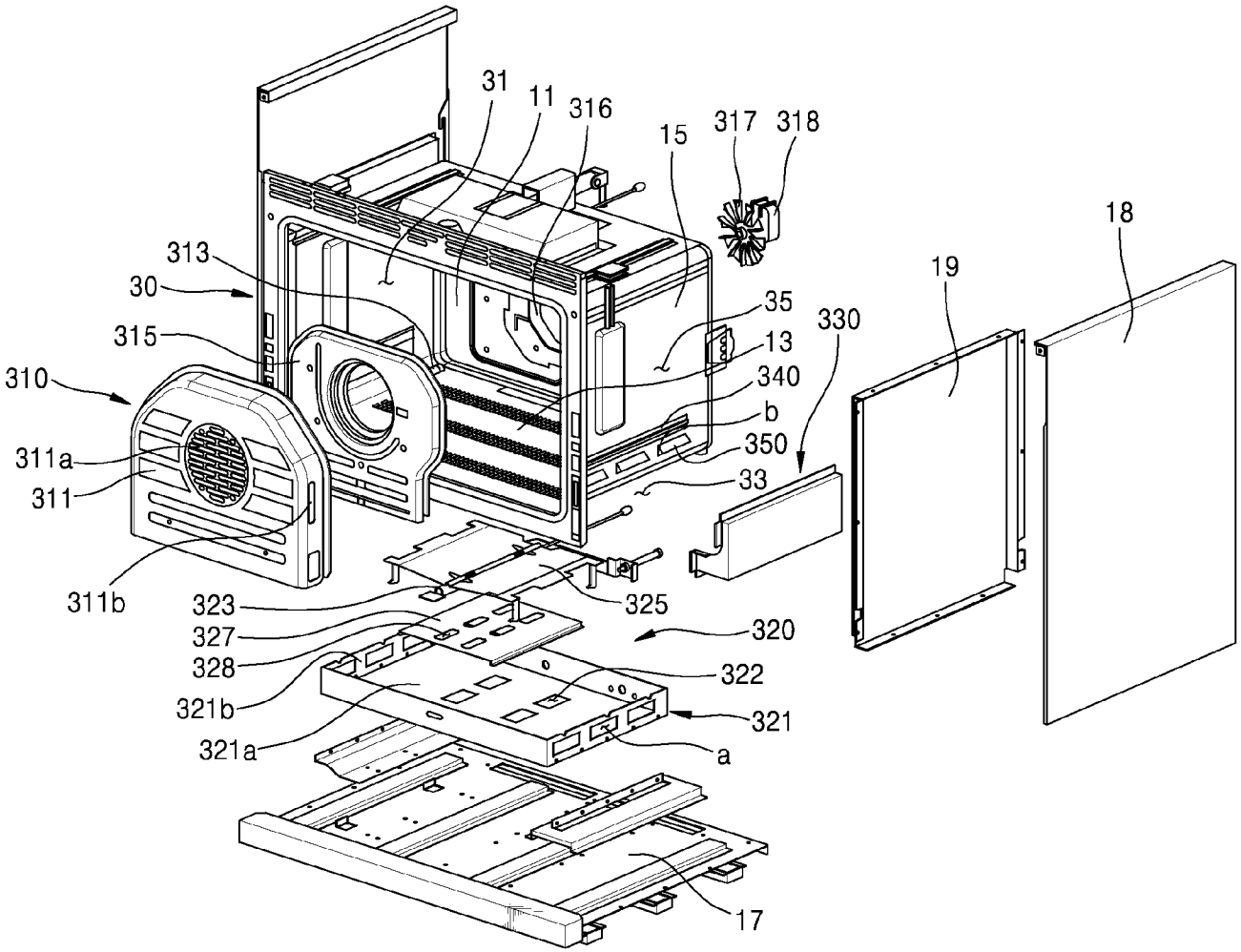
FIG. 3 is an exploded perspective view illustrating components of the oven of the cooking appliance illustrated in FIG. 1.
Figure 4:
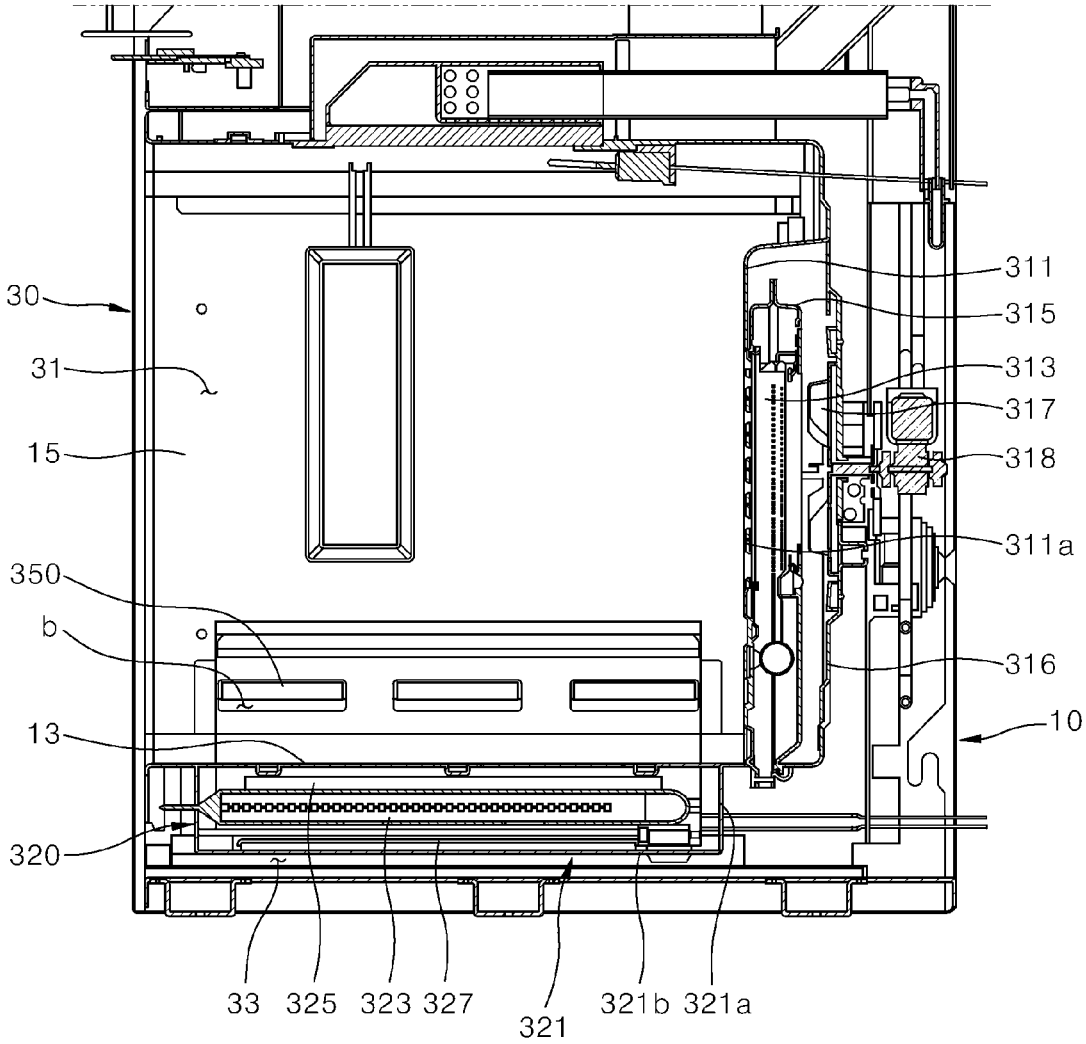
FIG. 4 is a cross-sectional view taken along line "IV-IV" in FIG. 1.
Figure 5:
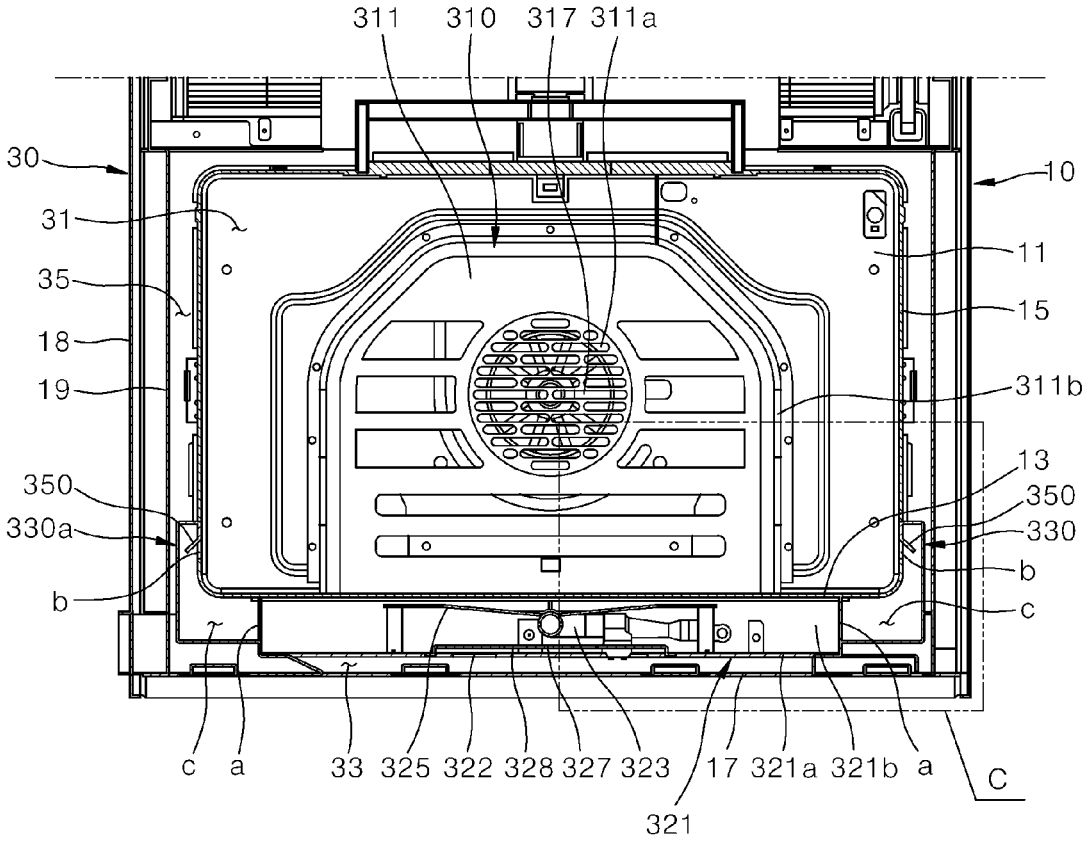
FIG. 5 is a cross-sectional view taken along line "V-V" in FIG. 1.

FIG. 3 is an exploded perspective view illustrating components of an oven of a cooking appliance illustrated in FIG. 1. FIG. 4 is a cross-sectional view taken along line "IV-IV" in FIG. 1. FIG. 5 is a cross-sectional view taken along line "V-V" in FIG. 1. Referring to FIGS. 3 to 5, the oven 30 of the cooking appliance may include a main body 10 configured to form a frame of the oven 30, a door 32 installed in front of the main body 10 to open and close a cooking chamber 31, a first or upper heating unit or assembly 310 installed inside the cooking chamber 31, and a second or lower heating unit or assembly 320 installed below an outer side of the cooking chamber 31.

According to the embodiment, the main body 10 may be approximately rectangular shaped, and may include a rear surface 11, a lower surface 13, and a side surface unit 15. The rear surface 11 may be located behind the cooking chamber 31 and may define a rear boundary of the cooking chamber 31 formed inside the main body 10. The rear surface 11 may form a rear surface of the cooking chamber 31 and may form the wall surface on which a fan cover 311 of the first heating assembly 310 is installed so that the first heating assembly 310 is located behind the cooking chamber 31.

The lower surface 13 may be located on a lower side of the cooking chamber 31 and may define a lower boundary of the cooking chamber 31 that is formed inside the main body 10. The lower surface 13 may form a lower surface of the cooking chamber 31 and may form a boundary configured to partition the cooking chamber 31 and a lower space portion 33 which will be described below.

The side surface 15 may be located on a side of the cooking chamber 31 and may define a side boundary of the cooking chamber 31 formed inside the main body 10. The side surface 15 may form a side surface of the cooking chamber 31 and may form a boundary configured to partition the cooking chamber 31 and a side space portion 35 which will be described below.

The lower surface 13 may be integrally connected to at least one of the rear surface 11 or the side surface 15. In the embodiment, the lower surface 13, the rear surface 11, and the side surface 15 may be integrally connected to each other so that each surface defining a boundary surface of the cooking chamber 31 may be seamlessly connected to each other. As a result, the inner surface of the cooking chamber 31 may be maintained as a smooth plane, so that contaminants adhering to the inner surface of the cooking chamber 31 may be easily removed and aesthetics inside the cooking chamber 31 may be improved.

The lower space portion 33 and the side space portion 35 in addition to the cooking chamber 31 may be formed inside the main body 10. The lower space portion 33 may be formed inside the main body 10 and below the outer side of the cooking chamber 31 so that a space separated from the cooking chamber 31 is formed between a bottom of the main body 10 and the cooking chamber 31. The cooking chamber 31 and the lower space portion 33 may be partitioned by the lower surface 13, and the lower space portion 33 formed as described above may be a space are installed 320 and a part of the flow path connection members 330 and 330*a* are installed, which will be described below.

The side space portion 35 may be formed inside the main body 10 and beside the outer side of the cooking chamber 31 so that a space separated from the cooking chamber 31 is formed beside the cooking chamber 31. The cooking chamber 31 and the side space portion 35 may be partitioned by the side surface 15, and the side space portion 35 formed as described above may be a space in which a part of a flow path connection members 330 and 330*a* and other parts related to the oven 30 are installed which will be described below. The side space portions 35 may be formed at both sides of the cooking chamber 31 in the main body 10.

The main body 10 may further include a bottom unit or panel 17 and side panel units (or side panels) 18 and 19. The bottom panel 17 may be provided at the lower portion of the main body 10 to form a bottom surface of the main body 10 and may define a lower boundary surface of the lower space portion 33 that is formed inside the main body 10. The side panels 18 and 19 may be installed beside both sides of the main body 10 to form side surfaces of the outer side of the main body 10 and define boundary surfaces of the outer side of the side space portions 35 formed inside the main body 10.

According to the embodiment, the side space portions 35 may be formed at both sides of the cooking chamber 31 in a lateral direction, and each side space portion 35 may form a space in which the side space portion is surrounded by the main body 10 in the form of a "⊏" shape when viewed from the top, i.e., three side surfaces thereof may be surrounded by the main body 10 and the remaining surface may be open in an outward direction. The side panels 18 and 19 may be installed on open portions of the main body 10 as described above to cover open portions of the side space portion 35 from the outside of the main body 10 and form an exterior of the side surface of the main body 10.

The side panels 18 and 19 may include an outer panel 18 and a gasket case 19. The outer panel 18 may have in a shape corresponding to the open shape at one side of the side space portion 35, and may be installed on each side portion of the main body 10. The outer panel 18 may cover the one open portion of the side space portion 35 from the outside of the main body 10 and form the exterior of the side surface of the main body 10, and may be installed so as to be detachably coupled to each side portion of the main body 10.

The gasket case 19 may be provided between the side surface 15 and the outer panel 18. The gasket case 19 may provide a heat insulation to block heat generated in the first heating assembly 310 and in the second heating assembly 320 respectively installed in the cooking chamber 31 and lower space portion 33 from being transferred to the outer panel 18. The gasket case 19 may be fixed or detachably coupled to the outer panel 18.

The side panels 18 and 19 provided as described above may cover one open portion of the side space portion 35 from the outside of the main body 10 to form the exterior of the side surface of the main body 10 when coupled to the side portion of the main body 10, and may be separated from the main body 10, when it is required, to open the inside of the side space portion 35 to the outside of the main body 10. The first heating assembly 310 may be provided inside the cooking chamber 31 to generate heat inside the cooking chamber 31. In the embodiment, the first heating assembly 310 may be a probake burner type.

The first heating assembly 310 may generate heat in the cooking chamber 31 and generate a circulation flow of the heat circulating the inside of the cooking chamber 31 so that the generated heat is uniformly transferred to the cooking chamber 31. A detailed description of a configuration of the first heating assembly 310 will be given below.

The second heating assembly 320 may be provided below the outer side of the cooking chamber 31 and inside the lower space portion 33, and may generate heat below the cooking chamber 31. In the embodiment, the second heating assembly 320 may be a bottom bake type water. The second heating assembly 320 may generate heat below the cooking chamber 31 and allow the generated heat to be transferred to the lower portion of food in the cooking chamber 31, thereby applying concentrated heating to the bottom surface of the food. A detailed description of the configuration of the second heating assembly 320 will be described below.

The first heating assembly 310 may be provided inside the cooking chamber 31 and may include a fan cover 311, a first heater 313, a burner cover 315, and a convection fan 317. The fan cover 311 may be installed behind the main body 10, more specifically on the rear surface 11 that forms a rear surface of the cooking chamber 31. For example, the fan cover 311 may be formed in a hexahedral shape of which a rear surface is open. The fan cover 311 may be coupled to the rear surface 11 so that the open rear surface of the fan cover 311 is covered by the rear surface 11 to form a separated accommodation space in the cooking chamber 31.

A suction port 311*a* and a discharge port 311*b* may be provided in the fan cover 311. The suction port 311*a* may pass through the front surface of the fan cover 311 toward the front of the cooking chamber 31, and the discharge port 311*b* may pass through a side surface of the fan cover 311, to face the side surface 15.

The first heater 313 may be provided in the accommodation space inside the fan cover 311 and may generate heat. The first heater 313 may be a probake burner type provided on the rear surface of the cooking chamber 31. Accordingly, the first heater 313 may be designed such that a plurality of flame holes are formed in a side portion of a burner body, which may be a hollow pipe that extends to form a curved line in a "U" shape.

The flow path may be formed in a burner body to supply a mixed gas. Also, the flame holes may form paths, and the gas supplied into the burner body may be discharged to an outside of the burner body through the flame holes.

A plurality of flame holes may be provided in the side portion of the burner body, and may be spaced apart from each other in an extending direction of the burner body. Thus, a plurality of paths for discharging gas may be provided in the burner body in the extending direction thereof.

According to the embodiment, a gas mixed with air, which is a mixed gas, may be supplied to the burner body through a mixing tube connected thereto. Also, the mixed gas supplied to the flow path inside the burner body may be discharged to the outside of the burner body through the flame holes, and burned to generate flames outside of the first heater 313, that is, in the accommodation space inside the fan cover 311.

The burner cover 315 may be located in the accommodation space inside the fan cover 311, and may include a pair of cover plates separated from each other in the front-rear direction and coupled to the burner cover 315. The first heater 313 may be accommodated in the burner cover 315, and a space may be formed to surround the flames generated in the first heater 313 from the outside of the flames.

The burner cover 315 provided as described above may restrict a region where the flames generated in the first heater 313 are diffused, and thus the flames generated in the first heater 313 may be stabilized. Also, the burner cover 315 may block the flames from coming into direct contact with the wall surfaces of the fan cover 311 and the cooking chamber 31.

The cooking appliance of the embodiment may further include a reflecting plate 316. The reflecting plate 316 may be located in the accommodation space inside the fan cover 311 and between the burner cover 315 and a rear wall of the cooking chamber 31. The reflecting plate 316 may block the heat generated by the flame generated in the first heater 313 from being transferred to the rear wall of the cooking chamber 31 to protect the coating layer, such as enamel, formed on the surface of the cooking chamber 31 from thermal damage.

The convection fan 317 may be located in the accommodation space inside the fan cover 311. The convection fan 317 may be rotated by a convection motor 318 connected to the convection fan 317 to generate an air flow. The convection fan 317 operated as described above may generate a circulation flow of air in which the air in the cooking chamber 31 is introduced into and heated in the accommodation space inside the fan cover 311 through the suction port 311*a* and discharged into the cooking chamber 31 through the discharge port 311*b*.

The second heating assembly 320 may be provided in the lower portion of the cooking chamber 31 and in a lower space portion 33 formed below the cooking chamber 31, which is a space separated from a cooking chamber 31 in which the first heating assembly 310 is installed. The lower heating assembly 320 may include a lower case 321, a second or lower heater 323, and a guide plate 325.

The lower case 321 may be installed in the lower space portion 33, and an accommodation space in which various components constituting the second heating assembly 320 are installed may be formed in the lower case 321. The lower case 321 may have an approximately rectangular shape and may be formed of a material having a predetermined strength to protect a plurality of parts installed in the accommodation space inside the lower case 321.

The lower case 321 may include a bottom surface unit (or bottom surface) 321*a* configured to form a bottom surface of the lower case 321 and a side wall unit (or side wall) 321*b* that extends upward from the bottom surface 321*a* and forms a side surface of the lower case 321. The second heater 323 may be installed in the accommodation space inside the lower case 321 to generate heat below the cooking chamber 31. The lower heater 323 may be a bottom bake burner type provided below the cooking chamber 31.

The lower heater 323 may be designed such that a plurality of flame holes is formed in a side portion of a burner body, which may be a hollow pipe that linearly extends in front-rear direction. As another example, the lower heater 323 may be designed such that a plurality of flame holes are formed in a side portion of a burner body, which may be a hollow pipe that extends to form a curved line in a "U" shape.

The main differences between the second heater 323 and the first heater 313 may be directions in which the flame holes are formed and locations where the flames are formed. Besides these, there may not be much difference in configuration between the first heater 313 and the second heater 323, so a detailed description of the second heater 323 will be omitted.

The guide plate 325 may be provided above the lower heater 323. The guide plate 325 may be provided between the lower surface 13 and the second heater 323. The guide plate 325 may block flames generated in the second heater 323 from coming into direct contact with the lower surface 13 which is the bottom surface of the cooking chamber 31 and may allow the heat generated by the combustion of the second heater 323 to be indirectly transferred to the lower surface 13.

The second heating assembly 320 of the embodiment may further include an air guide 327 provided below the second heater 323. The air guide 327 may be arranged between the bottom surface 321*a* which is the bottom surface of the lower case 321, and the second heater 323 to provide a barrier between the bottom surface 321*a* and the second heater 323. The flames may not spread to the bottom surface 321*a* due to the air guide 327 serving as a blocking wall, so that the flames generated by the combustion of the second heater 323 may be concentrated upward.

A plurality of through holes 322 may be formed in the bottom surface 321*a* to pass through the bottom surface 321*a* which is the bottom surface of the lower case 321.

Also, a plurality of pass holes 328 may be formed in the air guide 327 to pass through the air guide 327 provided at the upper portion of the bottom surface 321*a*.

The through holes 322 may form vertical paths in the bottom surface unit 321*a* so that outside air may flow into the lower case 321. Also, the pass holes 328 may form vertical paths in the air guide 327 and the outside air introduced through the through hole 322 may flow toward the second heater 323. That is, paths for allowing the outside air to flow into the second heater 323 may be formed in the second heating assembly 320. The outside air introduced into the second heater 323 through the paths may be used as secondary air for stable combustion in the second heater 323.

Preferably, the through holes 322 and the pass holes 328 may be formed such that locations thereof are misaligned from each other in a vertical direction. When the through holes 322 and the pass holes 328 are created, a sufficient width of the path may be ensured so that the secondary air may be smoothly supplied to the second heater 323, and the blocking wall capable of blocking the flames from spreading toward the bottom surface unit 321*a* may be maintained.

Figure 6:
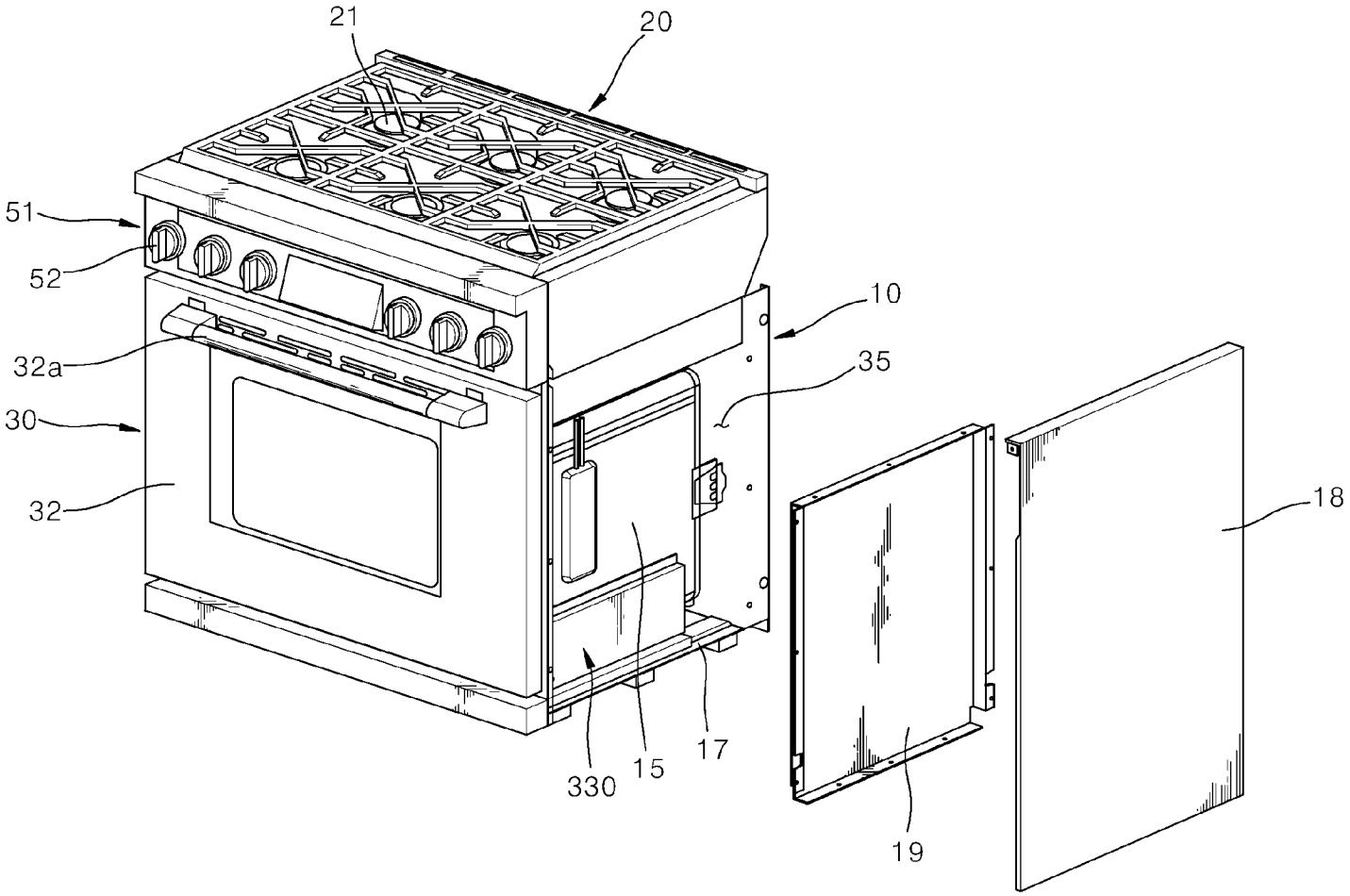
FIG. 6 is a perspective view illustrating a state in which a side panel is separated from the cooking appliance illustrated in FIG. 1.
Figure 7:
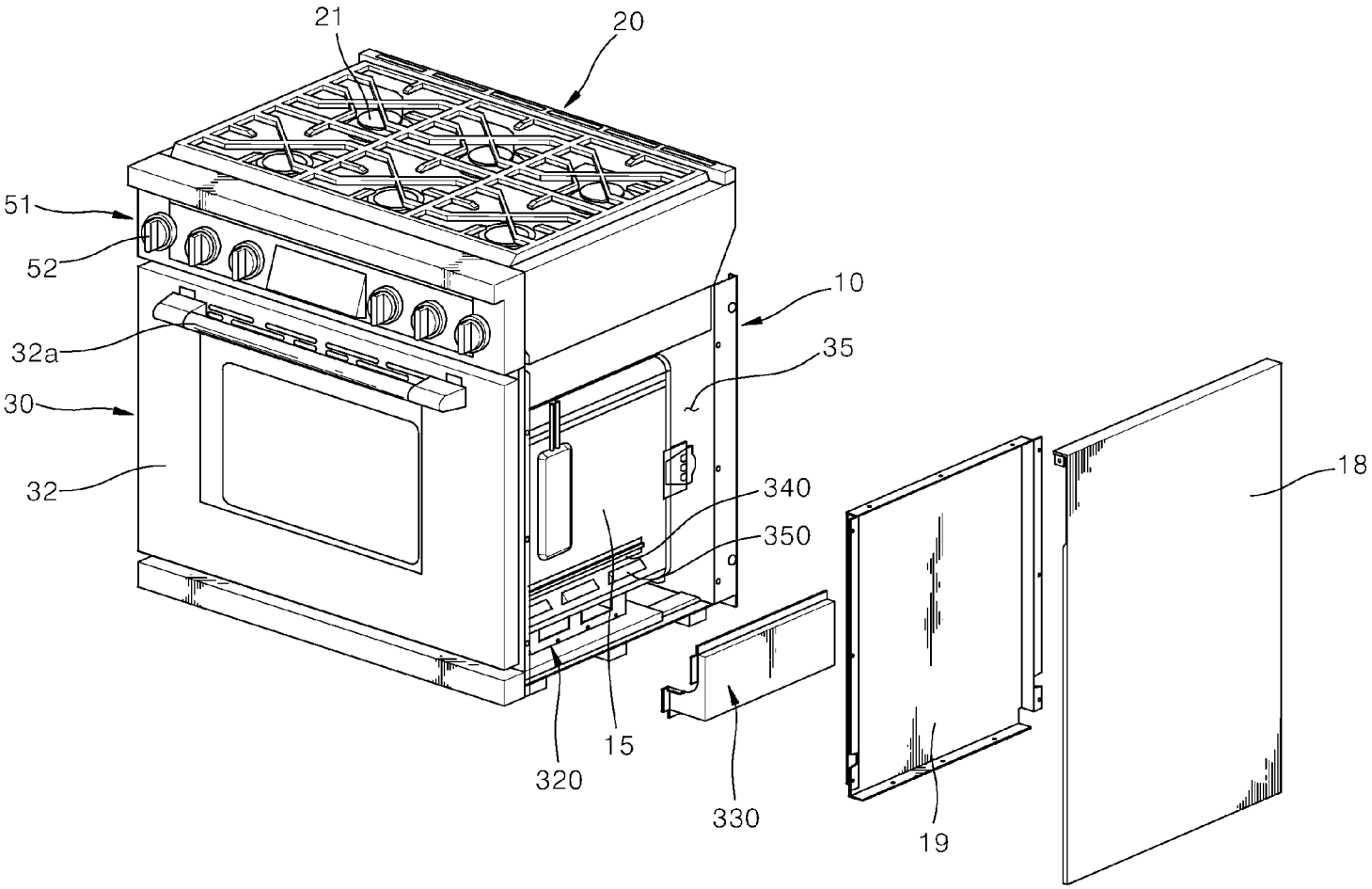
FIG. 7 is a perspective view illustrating a state in which a flow path connection member is separated from the cooking appliance illustrated in FIG. 6.
Figure 8:
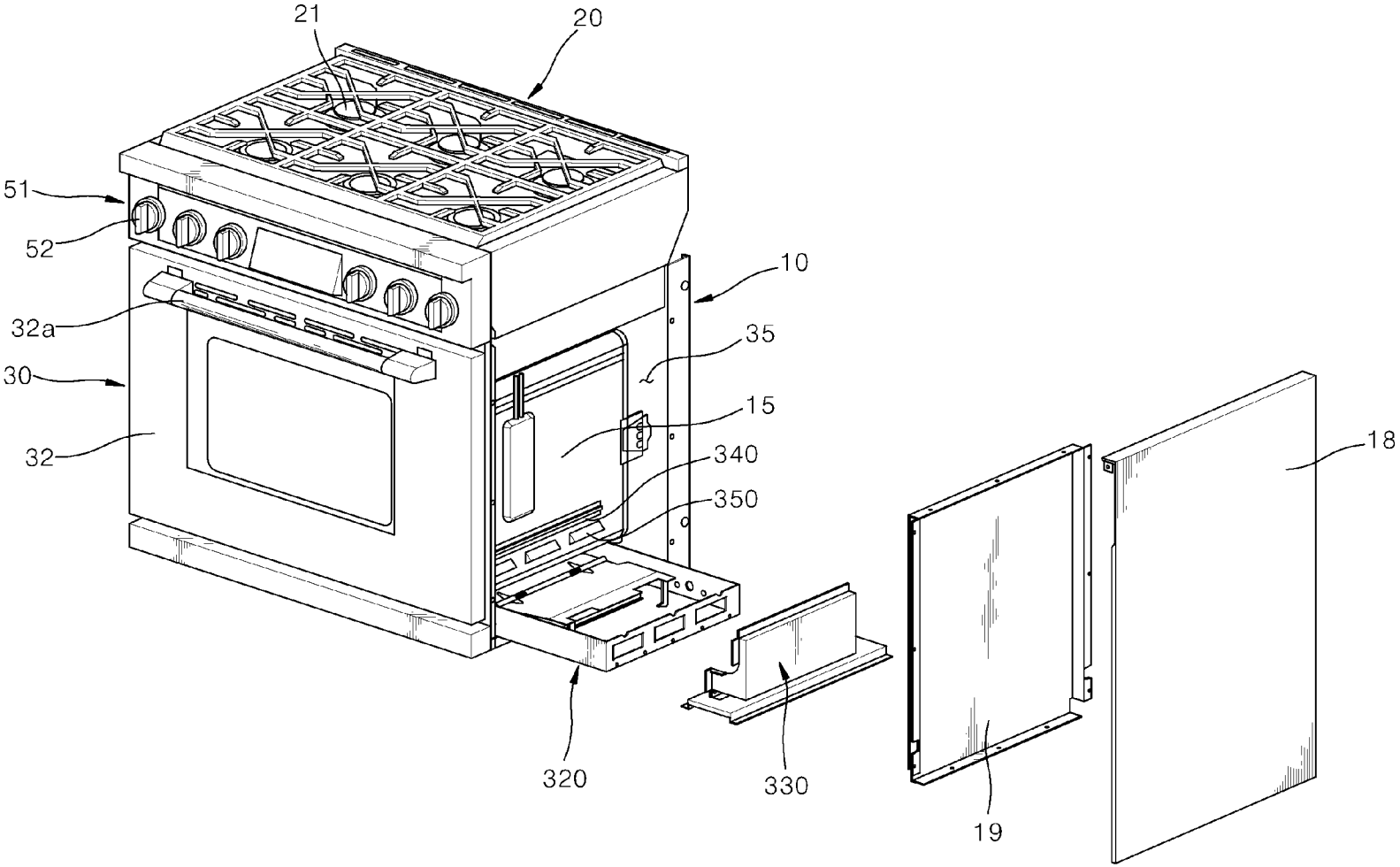
FIG. 8 is a perspective view illustrating a state in which a lower heating unit is partially withdrawn from the cooking appliance illustrated in FIG. 7.

FIG. 6 is a perspective view illustrating a state in which a side panel is separated from the cooking appliance illustrated in FIG. 1, FIG. 7 is a perspective view illustrating a state in which a flow path connection member is separated from the cooking appliance illustrated in FIG. 6, and FIG. 8 is a perspective view illustrating a state in which a second heating assembly is partially withdrawn from the cooking appliance illustrated in FIG. 7.

Referring to FIGS. 5 and 6, the first heating assembly 310 provided inside the cooking chamber 31 may generate heat in the cooking chamber 31 and may generate a circulation flow of heat circulating in the cooking chamber 31, thereby allowing the heat to be uniformly circulated within the cooking chamber 31. The second heating assembly 320, which is provided below the outside of the cooking chamber 31, may intensively heat a bottom surface of food within the cooking chamber 31 by generating heat from below the cooking chamber 31 so that food, such as pizza, becomes crispier.

That is, the cooking appliance of the embodiment may uniformly heat food in the cooking chamber 31 using the first heating assembly 310 and a may intensively heat a bottom surface of the food by using the second heating assembly 320. The cooking appliance may further provide a function of more quickly and effectively increasing a temperature in the cooking chamber 31 by transferring heat generated in the second heating assembly 320 into the cooking chamber 31. Hereinafter, a heat transfer structure for implementing such a function will be described.

According to the embodiment, a first discharge port a may be formed in or at the side wall 321*b* which is the side surface of the second heating assembly 320, and a second discharge port b may be formed in or at the side surface 15 which is the side surface of the cooking chamber 31. The first discharge port a may pass through the side wall 321*b* in a lateral direction and may form a lateral path connecting the inside and the outside of the lower case 321. The first discharge port a may serve as a path which connects the inside of the lower case 321 where the lower heater 323 is installed and the side space portion 35.

The second discharge port b may pass through the side surface 15 in a lateral direction and may form a lateral path connecting the inside and outside of the cooking chamber 31. The second discharge port b may serve as a path which connects the inside of the cooking chamber 31 and the side space portion 35.

In this case, each of the first discharge port a and the second discharge port b may form a path to be connected to the side space portion 35. That is, the first discharge port a and the second discharge port b may form a path connecting the inside of the lower case 321 and the side space portion 35 and a path connecting the side space portion 35 and the inside of the cooking chamber 31.

The cooking appliance of the embodiment may further include flow path connection members 330 and 330*a*. The flow path connection members 330 and 330*a* may be installed on an outer side of the cooking chamber 31 and may form a lateral path through which the heat generated in the second heating assembly 320 flows into the cooking chamber 31.

The flow path connection members 330 and 330*a* may each have the form of a duct of which a first side portion toward the cooking chamber 31 is open. The flow path connection members 330 and 330*a* may be provided on the outer side of the cooking chamber 31 and may include outer walls surrounding the periphery of the first discharge port a and the second discharge port b. In the flow path connection members 330 and 330*a*, a portion corresponding to the lower portion of the flow path connection members 330 and 330*a* may be arranged disposed in the lower space portion 33, and the remaining portions corresponding to an upper portion of the flow path connection members 330 and 330*a* may be arranged in the side space portion 35.

An outer wall formed by the flow path connection members 330 and 330*a* and a flow path guide c surrounded by the side surface 15 and the lower surface 13 to which the flow path connection members 330 and 330*a* may be coupled are formed inside the flow path connection members 330 and 330*a*. The flow path guide c formed in the inner space of the flow path connection member 330 and 330*a* may form a path that connects the first discharge port a and the second discharge port b. The flow path guide c may form a path passing through the lower space portion 33 and the side space portion 35, and may be defined by the flow path connection member 330 and 330*a* to be separated from the space formed in the lower space portion 33 and the side space portion 35.

That is, the flow path connection members 330 and 330*a* provided on the outer side of the cooking chamber 31 may form a path that connects the inside of the cooking chamber 31 and an inside of the second heating assembly 320 while passing through the lower space portion 33 and the side space portion 35. However, the flow path connection members 330 and 330*a* may form paths separated from spaces formed in the lower space portion 33 and the side space portion 35 in the lower space portion 33 and the side space portion 35. Thus, the cooking appliance of the embodiment may secure a path for transferring heat generated inside the second heating assembly 320 by combustion in the second heater 323 into the cooking chamber 31 through convection.

Worth noting about the heat transfer structure as described above is that a path (hereinafter, referred to as a "heat transfer path") through which the heat generated by the combustion of the second heater 323 may be transferred to the inside of the cooking chamber 31 by convection may be formed on the side portion of the cooking chamber 31 instead of on the lower portion of the cooking chamber 31. When the heat transfer path is formed in the lower portion of the cooking chamber 31, a heat transfer path of the shortest distance in which the heat inside the second heating assembly 320 can be directly transferred into the cooking chamber 31 may be formed. However, in order for the heat transfer path to be formed in the lower portion of the cooking chamber 31, holes that allow heat to pass therethrough may need to be formed in the lower surface 13 which is the bottom surface of the cooking chamber 31.

In the structure in which the holes are formed in the lower surface 13, that is, the bottom surface of the cooking chamber 31, the bottom surface of the cooking chamber 31 cannot maintain a smooth flat surface, and thus cleaning the bottom surface of the cooking chamber 31 is difficult because contaminants may exist in the holes of the bottom surface of the cooking chamber 31. In addition, in the above structure, foreign substances may be dropped into the second heating assembly 320 through the holes, and the second heating assembly 320 may become severely contaminated. As a result, the performance of the second heating assembly 320 may be degraded, and the number of accidents due to the ignition of contaminants may increase.

In contrast, in the cooking appliance of the embodiment, the heat transfer structure may be formed such that the heat transfer path is not formed in the lower portion of the cooking chamber 31 and is formed on the side portion of the cooking chamber 31. That is, in the embodiment, the inside of the second heating assembly 320 may open laterally through the first discharge port a and the inside of the cooking chamber 31 open laterally through the second discharge port b. As a result, a heat transfer path may be formed so that the flow path connection members 330 and 330*a* connect the two discharge ports A and B that open in the lateral direction.

Accordingly, the heat transfer path may not directly pass through the bottom surface of the cooking chamber 31. Instead, the heat transfer path may be formed in a "⊏" shape that surrounds the lower surface and the side surface of the cooking chamber 31 from the outside of the cooking chamber 31 to bypass the cooking chamber 31, and may be connected to the inside of the cooking chamber 31 through the second discharge port b formed on the side surface of the cooking chamber 31. In the heat transfer structure of the embodiment formed as described above, no holes are formed in the bottom surface of the cooking chamber 31, and the bottom surface of the cooking chamber 31 may maintain a smooth flat surface.

Since the cooking appliance of the embodiment including the heat transfer structure may be implemented in a planar shape having a smooth and flat surface on the bottom surface of the cooking chamber 31, contaminants on the bottom surface of the cooking chamber 31 can be easily removed. These design elements improve ease of cleaning and aesthetics inside the cooking chamber and may appeal to consumers. In addition, the cooking appliance of the embodiment including the above structure may prevent contaminants in the cooking chamber 31 from falling into the second heating assembly 320. As a result, the risk of degradation in performance or an accident of the second heating assembly 320 due to contamination may be reduced.

The flow path connection members 330 and 330*a* may be fixedly coupled to the main body 10 or may be detachably coupled to the main body 10. As illustrated in FIG. 7, in a case in which the flow path connection members 330 and 330*a* are detachably coupled to the main body 10, the second heating assembly 320 covered by the flow path connection members 330 and 330*a* may be exposed toward the side space portion 35 when the flow path connection members 330 and 330*a* are separated from the main body 10. The fact that the second heating assembly 320 is exposed to the side space portion 35 means that a lateral path through which the second heating assembly 320 installed at the lower portion of the cooking chamber 31 may be separated from the main body 10 may be secured.

That is, when the flow path connection members 330 and 330*a* are detachably coupled to the main body 10, it may be possible to design a second heating assembly 320 having a mounting structure in which the second heating assembly 320 may be separated from the main body 10 after separating the flow path connection members 330 and 330*a* from the main body 10, or design the flow path connection members 330 and 330*a* and the second heating assembly 320 to be detachable from the main body 10, as shown in FIG. 8.

Figure 9:
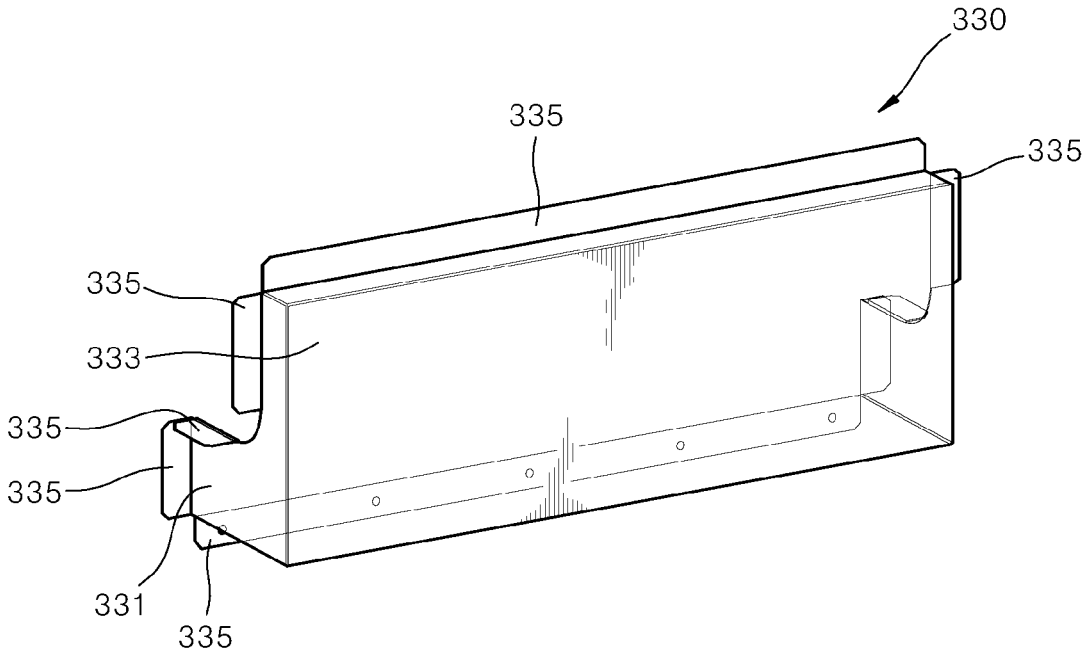
FIG. 9 is a perspective view illustrating a flow path connection member separated from the cooking appliance according to an embodiment.
Figure 10:
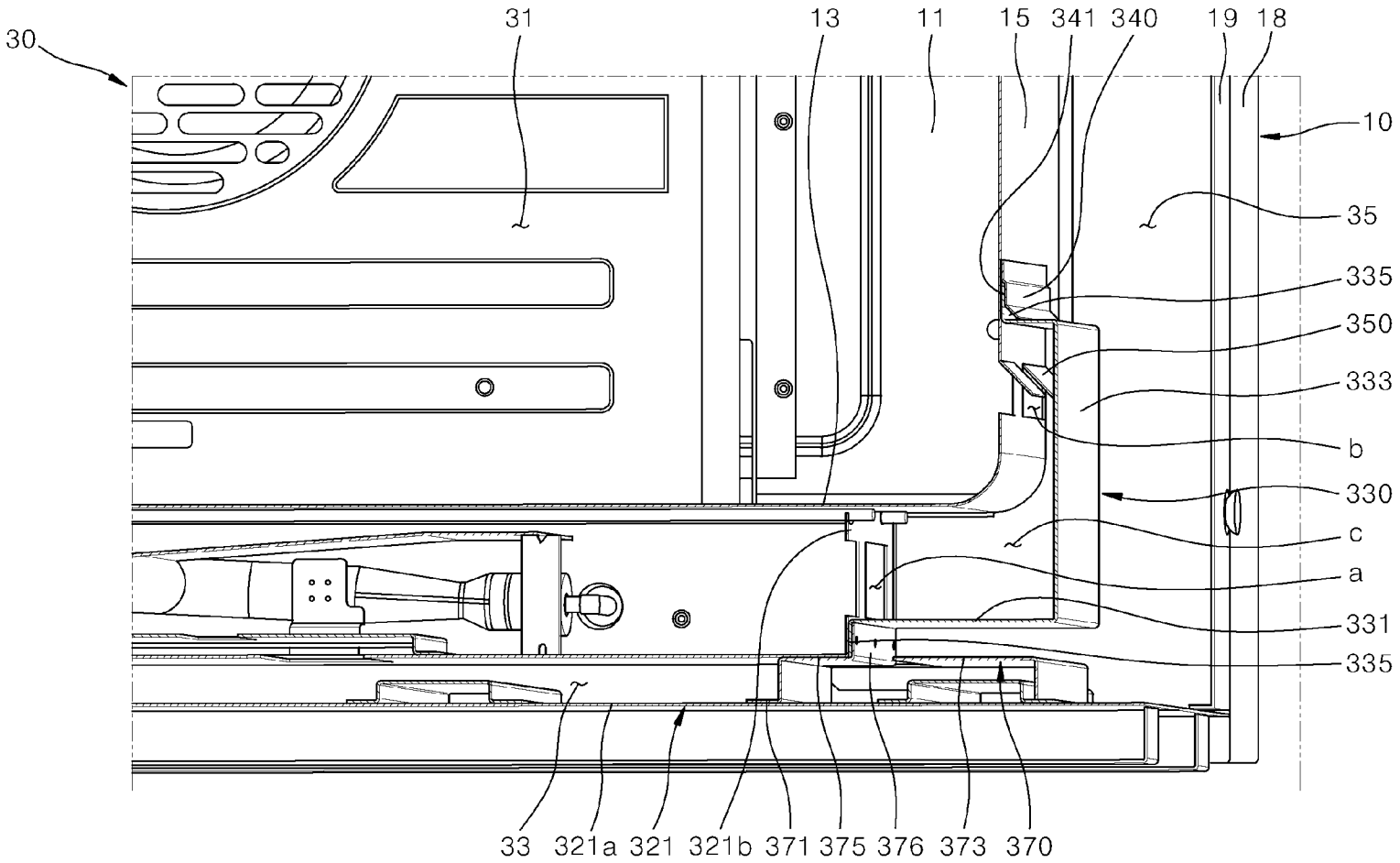
FIG. 10 is an enlarged cross-sectional perspective view of a portion "C" in FIG. 5.

FIG. 9 is a perspective view illustrating a flow path connection member separated from the cooking appliance according to one embodiment of the present disclosure, and FIG. 10 is an enlarged cross-sectional perspective view of a portion "C" in FIG. 5. Referring to FIGS. 9 and 10, the flow path connection member 330 may include duct units or sections 331 and 333 and coupling units or flanges 335.

The duct sections 331 and 333 may be installed on the outer side of a cooking chamber 31 to form an outer wall surrounding the flow path guide c from an outside of the flow path guide c. The flow path guide c may form a path connecting a first discharge port a and a second discharge port b in a space surrounded by the duct sections 331 and 333.

The duct sections 331 and 333 may include a first duct unit or section 331 forming an outer wall surrounding a peripheral portion of the first discharge port a and a second duct unit or section 333 forming an outer wall surrounding a peripheral portion of the second discharge port b. According to the embodiment, the lower case 321 may be provided such that the side wall 321*b* is located more laterally inward than the side surface 15. The first duct section 331 may be inserted into a space formed between the lower case 321 and the lower surface 13, inside the lower space portion 33, and the second duct section 333 may be provided inside the side space portion 35.

The first duct section 331 and the second duct section 333 may be connected to form an "L" shape. In this case, the first duct section 331 may be installed to contact the side wall 321*b* in the lower space portion 33, and the second section unit 333 may be installed to contact the side surface 15 in the side space portion 35.

The coupling flanges 335 may be provided such that the duct sections 331 and 333 are coupled to one of the side wall 321*b* and the side surface 15 of the lower case 321. The coupling flanges 335 may protrude from edges of the duct sections 331 and 333 in contact with the side surface 15 corresponding to the side surface of the cooking chamber 31 or the side wall 321*b* corresponding to the side surface of the lower case 321. Each of the coupling flanges 335 may be formed by bending each edge of each of the duct sections 331 and 333 in an outward direction of the duct sections 331 and 333. Each of the coupling flanges 335 is connected to the corresponding edge portion of the duct sections 331 and 333 to have an "L" shape.

The coupling flanges 335 may be parallel to the side surface 15 or the side wall 321*b*. Specifically, the coupling flanges 335 that protrude from the edge of the first duct section 331 may be parallel to the side wall 321*b* so that the coupling flange 335 and the side wall 321*b* are in contact with and coupled to each other. Also, coupling flanges 335 that protrude from the edge of the second duct section 333 may be parallel to the side surface 15 so that coupling flange 335 and the side surface 15 are in contact with and coupled to each other.

That is, each of the coupling flanges 335 formed at the respective edge portion of the duct sections 331 and 333 may be in surface contact with and coupled to the side wall 321*b* or the side surface 15, so that the duct sections 331 and 333 can be in contact with and tightly coupled to the side wall of the lower case 321 or the cooking chamber 31. In this case, coupling the coupling flange 335 and the side wall 321*b* and coupling the coupling flange 335 and the side surface 15 may be performed with coupling members such as bolts or the like which pass through and combine two members which are in surface contact and abutted each other.

As described above, the duct sections 331 and 333 coupled with the side surface of the lower case 321 or the cooking chamber 31 may be tightly coupled to the designated location to stably maintain a location of the flow path guide c formed inside the side surface of the lower case 321 and the cooking chamber 31. Also, if necessary, the duct sections 331 and 333 may be easily separated from the side surface of the lower case 321 or the cooking chamber 31.

The flow path connection member 330 may have a space formed therein in the form of a duct having one side portion open towards the cooking chamber 31. That is, the flow path connection member 330 may have an "L" shape in which the first duct section 331 has an open upper portion facing the lower surface 13 is open, and the second duct section 333 has an open side portion facing the side surface 15. In the flow path connection member 330, the open upper portion of the first duct section 331 may be tightly coupled to the lower surface 13 and the open side portion of one side of the second duct section 333 may be tightly coupled to the side surface 15.

Thus, the flow path guide c surrounded by the first duct section 331 and the lower surface 13 coupled to each other may be formed inside the first duct section 331, and the flow path guide c surrounded by the second duct section 333 and the side surface 15 coupled to each other may also be formed inside the second duct section 333. As a result, the flow path guide c extending in an "L" shape may be formed inside the flow path connection member 330. As another example, the flow path connection member 330 may be a duct having a first end portion opened toward the first discharge port a and a side of a second end portion opened toward the second discharge port b.

However, as exemplified in the embodiment, when the flow path connection member 330 is provided in the form of a duct in which a space is formed inside the flow path connection member 330 and a side portion of the first side thereof is open toward the cooking chamber 31, a material cost required for manufacturing the flow path connection member 330 may be reduced and the flow path connection member 330 may be manufactured more easily. Also, since the open portion of the flow path connection member 330 allows a plurality of flow path connection members 330 to be stacked and stored, the flow path connection member 330 necessary for manufacturing the cooking appliance may be easily stored and handled.

The cooking appliance of the embodiment may further include a clip member (or clip) 340. The clip 340 may be provided on the outer side of the side surface 15 and may press a part of an engaging portion formed on the edge portion of the flow path connection member 330 so that the engaging portion is pressed against the side surface 15.

The clip 340 may be provided on the outer side of the side surface 15 and above the second discharge port b. The clip 340 may be provided in the form of a leaf spring with elasticity capable of pressing a lower portion thereof against the side surface 15.

The upper side portion of the clip 340 may be fixedly coupled to the side surface 15. Also, the lower side portion of the clip 340 extending downward from the upper side portion of the clip 340 that is fixedly coupled to the side surface 15 may not be coupled to the side surface 15. As a result, an insertion groove 341 of which an upper portion is closed and a lower portion is open may be formed between the side surface 15 and the clip 340.

A part of the coupling flange 335, more specifically at least a part of the coupling flange 335 formed on the upper edge portion of the second duct section 333, may be inserted into the insertion groove 341 formed as described above. The coupling flange 335 may be inserted until the upper end portion of the coupling flange 335 is interfered with by the blocked upper portion of the insertion groove 341 and a location of the flow path connection member 330 in a vertical direction may be guided by insertion-coupling the clip 340 and the coupling flange 335.

That is, when installing the flow path connection member 330, by simply inserting and pushing the upper end portion of the flow path connection member 330 into the clip 340, a location in the vertical direction on which the flow path connection member 330 is installed may be guided, and at the same time, the upper end portion of the flow path connection member 330 may be temporarily fixed. Therefore, it is possible to easily perform an operation of coupling the flow path connection member 330 to the lower case 321, or the lower surface 13 or side surface 15 using the coupling member.

The cooking appliance of the embodiment may further include a heat guide unit (or heat guide) 350. The heat guide 350 may change a flow direction of heat flowing upward through the flow path guide c to a direction passing through the second discharge port b.

The heat guide 350 may protrude from the side surface 15 to be arranged in the flow path guide c formed in the flow path connection member 330. The heat guide 350 formed as described above may form a blocking wall above the second discharge port b to block the flow of heat flowing along the flow path guide c.

The heat guide 350 may have a shape having an inclined surface, wherein a distance from the inclined surface to the side surface 15 is decreased in an upward direction. A flow of heat flowing upward along the flow path guide c can be simply guided to the second discharge port b along the inclined blocking wall formed by the heat guide 350, and thereby the discharge of the heat through the side portion of the cooking chamber 31 may become more smooth.

The second discharge port b and the heat guide 350 may be formed by incising a part of the side surface 15. Accordingly, after incising a part of the side surface 15, the heat guide 350 may be formed by bending the incised part outwardly from the side surface 15 around the upper portion connected to the side surface 15. Further, the second discharge port b may be formed in a portion where the heat guide 350 is separated from the side surface 15. That is, according to the cooking appliance of the embodiment, since the path for supplying heat to the side portion of the cooking chamber 31 and a structure for guiding a flow of the heat to the path can be formed at once by a simple operation of incising and bending a part of the side surface 15 without adding additional structure, it is possible to provide an additional advantage of being able to control cost and time required for manufacturing the cooking appliance.

Figure 11:
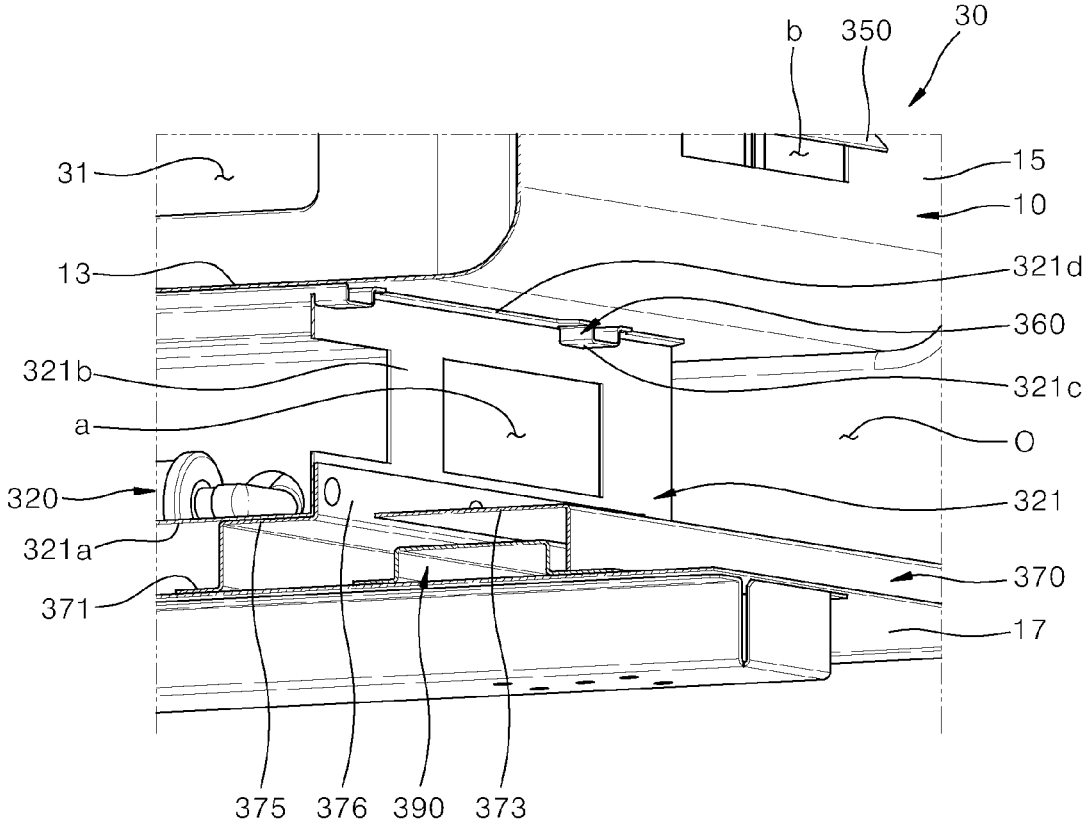
FIG. 11 is a cross-sectional perspective view illustrating a state in which the flow path connection member is removed from the cooking appliance illustrated in FIG. 10.
Figure 12:
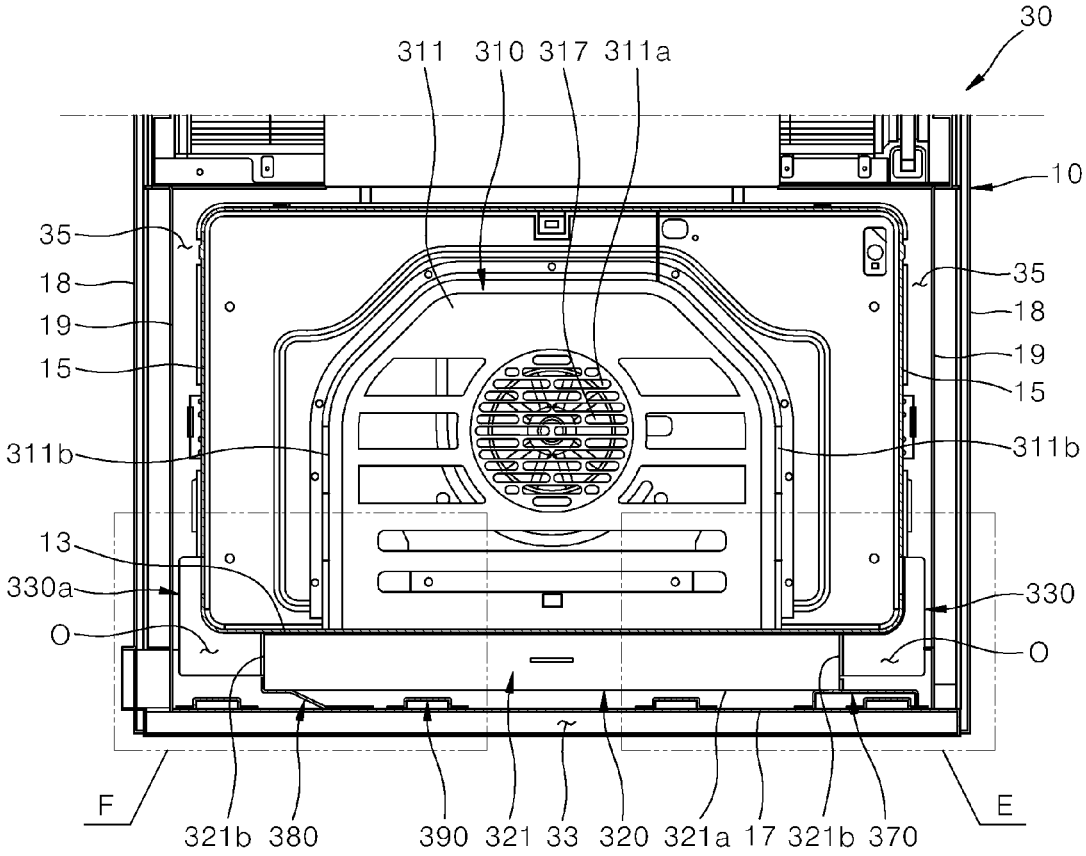
FIG. 12 is a cross-sectional view taken along line "XII-XII" in FIG. 1.

FIG. 11 is a cross-sectional perspective view illustrating a state in which the flow path connection member is removed from the cooking appliance illustrated in FIG. 10, and FIG. 12 is a cross-sectional view taken along the line "XII-XII" in FIG. 1. Referring to FIGS. 11 and 12, the second heating assembly 320 may be installed in the main body 10 to be withdrawable therefrom.

An opening portion O through which a lower space portion 33 between the bottom of the main body 10 and the cooking chamber 31, that is, between the bottom panel 17 and the lower surface 13, may be open toward the outside of the main body 10, more specifically to the side space portion 35, may be formed in the lower space portion 33. The opening portion O, acting as a virtual boundary between the lower space portion 33 and the side space portion 35 connected to each other in the lateral direction, may be a portion formed between the lower space portion 33 and the side space portion 35 to form a path connecting the lower space portion 33 and the side space portion 35.

The second heating assembly 320 may be inserted into the lower space portion 33 through the opening portion O formed as described above or may be withdrawn from the lower space portion 33. In this case, an installation structure of the second heating assembly 320 that may be inserted into and withdrawn from the lower space portion 33 may be achieved through an installation structure of the lower case 321 installed to be slidable in the main body 10. Hereinafter, a slidable installation structure of the lower case 321 that is installed to be withdrawable in the main body 10 will be described in detail.

A space into which the lower case 321 forming an exterior of the second heating assembly 320 may be inserted may be provided in the lower space portion 33, and the opening portion O through which the side portion of the lower space portion 33 is open to the side space portion 35 may be formed in the side portion of the lower space portion 33. The lower case 321 may be slidably inserted into the lower space portion 33 from the outside of the main body 10 through the opening portion O and may be withdrawable to the outside of the main body 10 through the opening portion O from the lower space portion 33. In this case, the opening portion O may form a lateral path between the lower space portion 33 and the side space portion 35, and thus the lower case 321 may be slidable in the lower space portion 33 in the lateral direction.

Various components for to guide a guiding sliding of the lower case 321 or to fix a location of the installed lower case 321 may be provided in the cooking appliance of the embodiment. A detailed description of components will be described below.

One of various components to guide a sliding of the lower case 321 or to fix a location of the installed lower case 321 may be configured to guide a sliding of the lower case 321 at the upper portion of the lower case 321. According to the components, as illustrated in FIG. 11, a guide protrusion 360 may be provided at an upper portion of the lower space portion 33, and a guide groove 321*c* may be formed in the lower case 321 with which the guide protrusion 360 is engaged.

The guide protrusion 360 may be installed on the lower surface 13 that is a lower boundary surface of the cooking chamber 31 and may be provided in a shape protruding from the lower surface 13 toward the lower case 321. The guide protrusion 360 may extend in a lateral direction, that is, in a sliding direction of the lower case 321, thereby forming a path to guide the sliding of the lower case 321.

The guide groove 321*c* into which the guide protrusion 360 is inserted may be concavely formed in a shape corresponding to the shape of the guide protrusion 360 at the upper end of the side wall 321*b* configured to form the side surface of the lower case 321. The guide groove 321*c* may be formed in each of a pair of side wall units (or side walls) 321*b* that face each other in the lateral direction among the four side walls 321*b* configured to form the side surface of the lower case 321. The guide protrusion 360 may be engaged with the side wall 321*b* by insertion-coupling the guide protrusion 360 and the guide groove 321*c*.

The lower case 321 may be coupled to the guide protrusion 360 to be slidable by engaging the guide protrusion 360 and the side wall 321*b*. Thus, the lower case 321 may be coupled with the main body 10 to be slidable in the lateral direction while restricting movement in a front-rear direction.

Three guide protrusions 360 may be provided at a predetermined interval in the front-rear direction, and guide grooves 321*c* corresponding to the three guide protrusions 360 may be formed in the respective side walls 321*b*. Accordingly, the guide protrusion 360 may be engaged with the lower case 321 at a plurality of points, and thus movement of the lower case 321 in the front-rear direction may be decreased and the lower case 321 may slide more stably.

In addition, a contact surface unit (or contact surface) 321*d* configured to form a contact surface with the lower surface 13 at an upper portion of the side wall 321*b* may be formed in the lower case 321. The contact surface 321*d* may be bent at the upper end portion of the side wall 321*b* to form a flat surface parallel to the lower surface 13, in surface contact with the lower surface 13, and may be pressed against the lower surface 13. The contact surface 321*d* may improve strength of the side wall 321*b* and make surface contact between the upper end portion of the side wall 321*b* and the lower surface 13, and thus the contact surface 321*d* may increase a degree of contact between the lower case 321 and the lower surface 13.

Referring to FIG. 12, the first discharge port a may be formed in each of a pair of side walls 321*b* that face each other in the lateral direction among the four side walls 321*b* configured to form the side surface of the lower case 321, that is, in a side wall 321*b* provided on a side of the opening portion O and in a side wall 321*b* that faces the opening portion O. Also, the second discharge port b may be formed on each of a pair of side surfaces 15 facing each other.

For convenience of description, hereinafter, the side wall 321*b* located on the side of the opening portion O will be referred to as a left side wall 321*b* and the side wall 321*b* that faces the opening portion O will be referred to as a right side wall 321*b*, and the side surface 15 located on the side of the opening portion O will be referred to as a left side surface 15 and the side surface unit 15 that faces the opening portion O will be referred to as a right side surface 15. Also, the flow path connection members 330 and 330*a* may be divided into a first flow path connection member 330 provided on the side of the opening portion O to form the flow path guide c, and a second flow path connection member 330*a* provided on the opposite side of the first flow path connection member 330.

Figure 13:
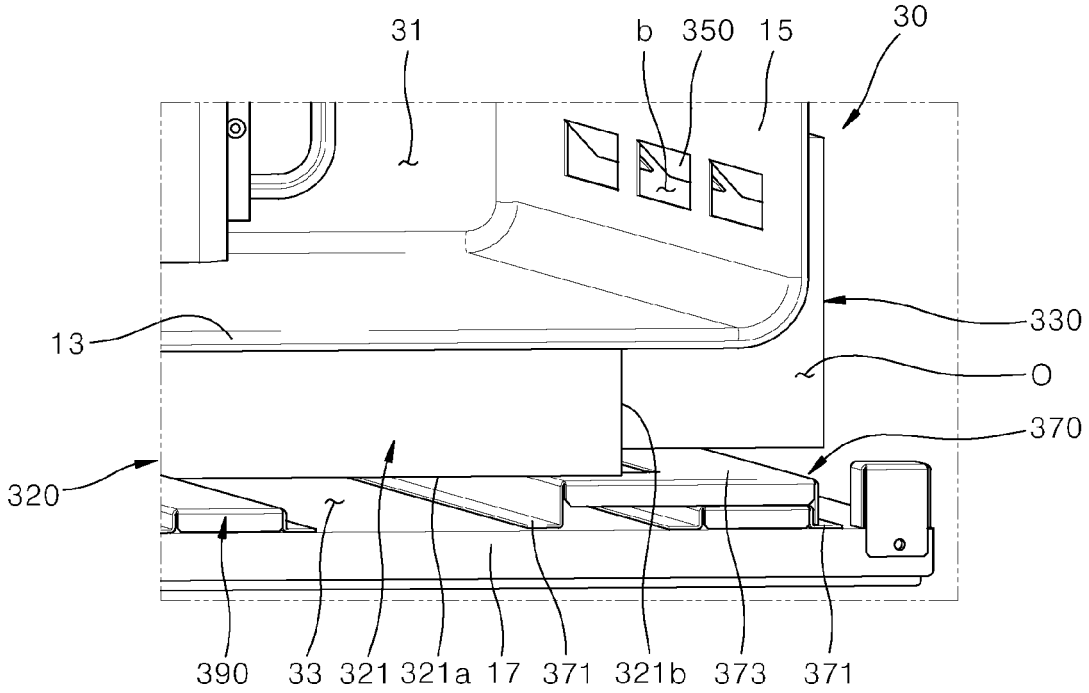
FIG. 13 is an enlarged cross-sectional view of a portion "E" in FIG. 12.
Figure 14:
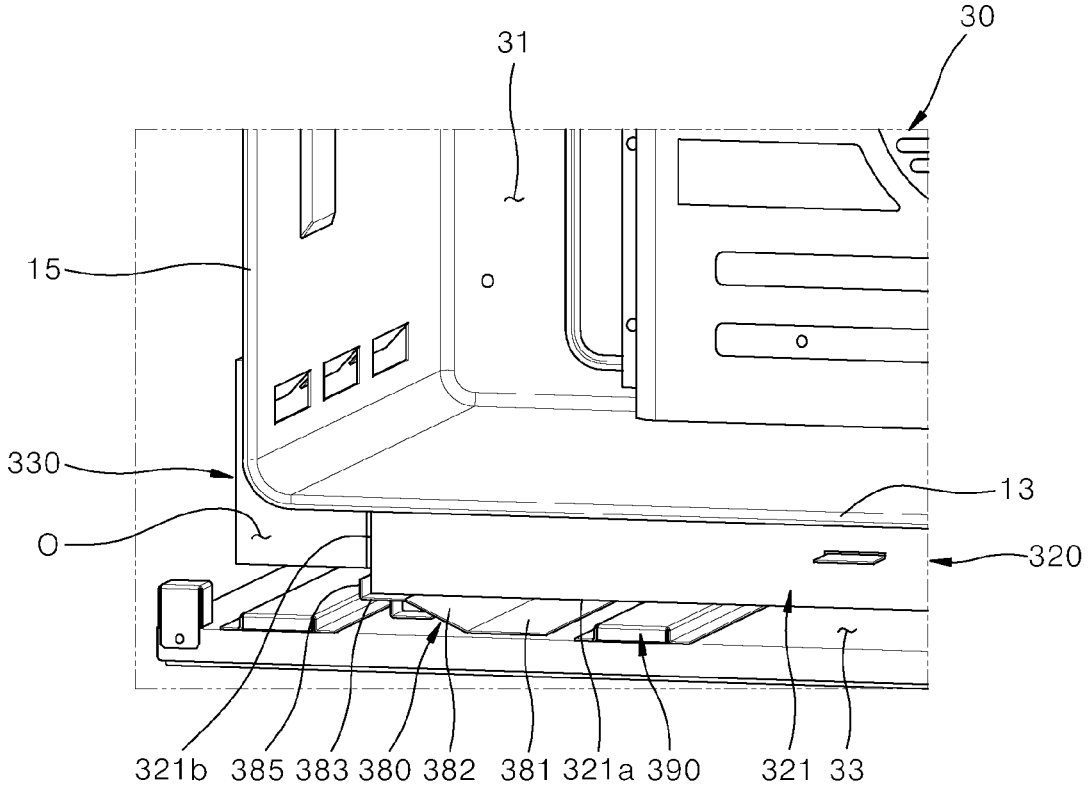
FIG. 14 is an enlarged cross-sectional view of a portion "F" in FIG. 12.

FIG. 13 is an enlarged cross-sectional view of a portion "E" in FIG. 12, and FIG. 14 is an enlarged cross-sectional view of a portion "F" in FIG. 12. Referring to FIGS. 12 and 13, the first flow path connection member 330 may be fixedly coupled to each of the left side surface 15 and the left side wall 321*b* at the side of the opening portion O, thereby fixing the lower case 321 to the main body 10.

As an example, the first flow path connection member 330 may be coupled to the left side surface 15 such that the coupling members pass through and engage two opposing members when the coupling flange 335 formed on the edge of the second duct section 333 is in surface contact with the left side surface 15 as illustrated in FIGS. 10 and 13. As another example, the first flow path connection member 330 may be coupled with the left side surface 15 only by coupling the coupling flange 335, which is formed at the upper edge portion of the second duct section 333, and the clip 340.

As still another example, the first flow path connection member 330 may be coupled with the left side surface 15 by coupling the coupling flange 335, which is formed at the upper end portion of the second duct section 333, and the clip 340 and coupling the side surface 15 and the remaining coupling flange 335, fixed by using coupling members. Also, the first flow path connection member 330 may be coupled to the left side wall 321*b* such that the coupling members pass through and engage two opposing members in a state in which the coupling flanges 335 formed on the edge of the first duct section 331 is in surface contact with the left side wall 321*b*.

In order to allow the lower case 321 to be withdrawn from the main body 10, a path may be created in which the lower case 321 may be laterally withdrawn through the opening portion O by separating the coupling members connecting the first flow path connection member 330 and the left side surface 15 therefrom and releasing the coupling between the first flow path connection member 330 and the left side surface 15. In this case, when the lower case 321 is withdrawn from the main body 10, the first flow path connection member 330 together with the lower case 321 may be separated from the main body 10 (see FIG. 15).

As another example, in order to withdraw the lower case 321 from the main body 10, both the coupling between the first flow path connection member 330 and the left side surface 15 and the coupling between the first flow path connection member 330 and the left side wall 321*b* may be released. In this case, a path through which the lower case 321 may be laterally withdrawn from the main body 10 through the opening portion O may be created when the first flow path connection member 330 is fully separated from the left side surface 15 and the lower case 321.

Referring to FIGS. 12 and 14, the second flow path connection member 330*a* may be fixedly coupled to the right side surface 15 at a side facing the opening portion O, and may be in contact with and detachable from the right side wall 321*b*. For example, the second flow path connection member 330*a* may be coupled to the right side surface 15 such that the coupling members pass through and engage two opposing members when the coupling flanges 335 formed on the edge of the second duct section 333 (see FIG. 9) is in surface contact with the right side surface section 15.

As another example, the second flow path connection member 330*a* may be coupled with the right side surface 15 only by coupling the coupling flange 335, which is formed at the upper edge portion of the second duct section 333, and the clip 340. As still another example, the second flow path connection member 330*a* may be coupled with the right side surface 15 by coupling the coupling flange 335, which is formed at the upper end portion of the second duct section 333, and the clip 340 and coupling the side surface 15 and the remaining coupling flange 335 fixed by using coupling members.

However, on the side facing the opening portion O, unlike the opening portion O, the second flow path connection member 330*a* may be separated from the lower case 321 when the lower case 321 is withdrawn from the main body 10, and the coupling between the second flow path connection member 330*a* and the right side surface 15 may be difficult to maintain when the second flow path connection member 330*a* is separated from the lower case 321. Therefore, the coupling between the second flow path connection member 330*a* and the right side surface 15 may include coupling using a coupling member.

Referring to FIG. 12, a cooking appliance of the embodiment may further include supporting members (or supports) 370 and 380. Supports 370 and 380 may be provided on the bottom panel 17 and may support the lower case 321 so that the lower case 321 inserted into the lower space portion 33 is disposed at a set position. According to the embodiment, supports 370 and 380 may be divided into a first supporting member (or first support) 370 and a second supporting member (or second support) 380.

The first support 370 may be provided the opening portion O, that is, on the left side wall 321*b* of the lower case 321. The first support 370 may block the lower case 321 installed at the set position from moving in a withdrawing direction and may support the left portion of the lower case 321 from the lower side.

The second support 380 may be provided on the side facing the opening portion O, that is, on the right side wall 321*b* of the lower case 321. The second support 380 may block the lower case 321 installed at the set position from moving in an insertion direction and may support the right portion of the lower case 321 from the lower side.

That is, both lateral sides of the lower case 321 of the embodiment may be supported in an upper direction by the first support 370 and the second support 380, which may be arranged apart from each other in a lateral direction. The lower case 321 supported by the supports 370 and 380 may be installed at a position spaced apart from the bottom panel 17 by a predetermined interval. Also, the lower case 321 may be installed at a set position in which the second heater 323 installed in the lower case 321 combusts efficiently and stably, and the lower case 321 is smoothly coupled with the flow path connection members 330 and 330*a*.

Hereinafter, a detailed configuration of the first support 370 and the second support 380 will be described. Referring to FIGS. 12 and 13, the first support 370 may include a first coupling unit (or first support flange) 371, a first supporting unit (or first support panel) 373, and first stopping units (or first stoppers) 375 and 376.

The first support flange 371 may be parallel to the bottom panel 17 and may be coupled to the upper portion of the bottom panel 17. The first support panel 373 may be connected to the first support flange 371, and may be installed on the bottom panel 17 to form a support surface to support the bottom surface of the lower case 321 from the lower portion at a position spaced upwardly from the bottom panel 17.

The first support panel 373 may have "⊓" shaped cross section, and the first support flange 371 may be formed at both lower end portions of the first support panel 373 to protrude outward from the first support panel 373.

The first stopping units 375 and 376 may protrude upward from the first support panel 373. These first stopping units 375 and 376 may interfere with the left side wall 321*b* of the lower case 321 positioned at the set position. The first stopping units 375 and 376 may include a stopping plate 375 protruding upward from the first support panel 373 to form a vertical blocking wall, and a first connecting plate 376 that connects the stopping plate 375 to the first support panel 373, which may be elastically deformable in the vertical direction.

The first stopping units 375 and 376 may be formed by incising and bending a portion of the first support panel 373. That is, a portion of the first support panel 373 may have a "⊏" shape to form the first connecting plate 376, and a part of the first connecting plate 376 formed as described above may be bent upwardly to form the stopping plate 375.

In this case, the first connecting plate 376 may be elastically deformed in the vertical direction around one side thereof connected to the first support panel 373, and the position of the stopping plate 375 connected to the first connecting plate 376 may be elastically deformed in a downward direction by a pressing force applied in the downward direction, and when the applied pressing force is removed, the stopping plate 375 may be returned to an initial position.

The first connecting plate 376, which may be elastically deformable as described above, may provide an elastic force to push the left portion of the lower case 321 in an upward direction. The first connecting plate 376 may suppress a leakage of heat through a gap between the lower case 321 and the lower surface 13 and rattling of the lower case 321 by increasing a degree of contact between the lower case 321 and the lower surface 13 by pressing the left side portion of the lower case 321 in the upper direction.

Referring to FIGS. 12 and 14, the second support 380 may include a second coupling unit (or second support flange) 381, a connecting unit (or second connecting plate) 382, a second supporting unit (or second support panel) 383, and a second stopping unit (or second stopper) 385.

The second support flange 381 may be parallel to the bottom panel 17 and may be coupled to the upper portion of the bottom panel 17, and the second support panel 383 may extend upward from the second support flange 381. Also, the second support panel 383 may extend from the second connecting plate 382 in the inserting direction of the lower case 321 to form a support surface to support the bottom surface of the lower case 321 from the lower portion at a position spaced apart from the bottom panel 17.

The second stopper 385 may protrude upward from the second support panel 383 and may be positioned at a set position to interfere with the right side wall 321*b*, that is, the side portion facing the opening portion O of the lower case 321. the second support 380 is exemplified to be formed by bending a rectangular metal plate a plurality of times. That is, with respect to a location where the second support flange 381 is formed, a boundary between the second support flange 381 and the second connecting plate 382 may be formed when the rectangular metal plate is bent in the upward direction, a boundary between the second connecting plate 382 and the second support panel 383 may be formed when the metal plate is bent downward in the region corresponding to the second connecting plate 382, and a boundary between the second support panel 383 and the second stopper 385 may be formed when the metal plate material is bent in the upward direction in the region corresponding to the second support panel 383.

In this case, the second connecting plate 382 may not extend in the vertical direction from the second support flange 381 but may extend in the form of an inclined surface inclined upward in the inserting direction of the lower case 321, that is, in the direction toward the side facing the opening portion O. The second connecting plate 382 forming the inclined surface may be a guide surface to guide the lower case 321 to slide smoothly toward the second support panel 383 when the lower case 321 is being inserted.

Also, the second connecting plate 382 that is inclined and extends as described above may be elastically deformed in the vertical direction around one side thereof connected to the second support flange nit 381. Thus, the second connecting plate 382 provided to be elastically deformable may provide an elastic force to push the second support panel 383 in the upward direction. Also, the second support panel 383 pushed upward by the elastic force may suppress a leakage of heat through a gap between the lower case 321 and the lower surface 13 and the rattling of the lower case 321 by increasing a degree of contact between the lower case 321 and the lower surface 13 by applying pressure in the upper direction to the right side portion of the lower case 321 that is supported by the second support panel 383.

Figure 15:
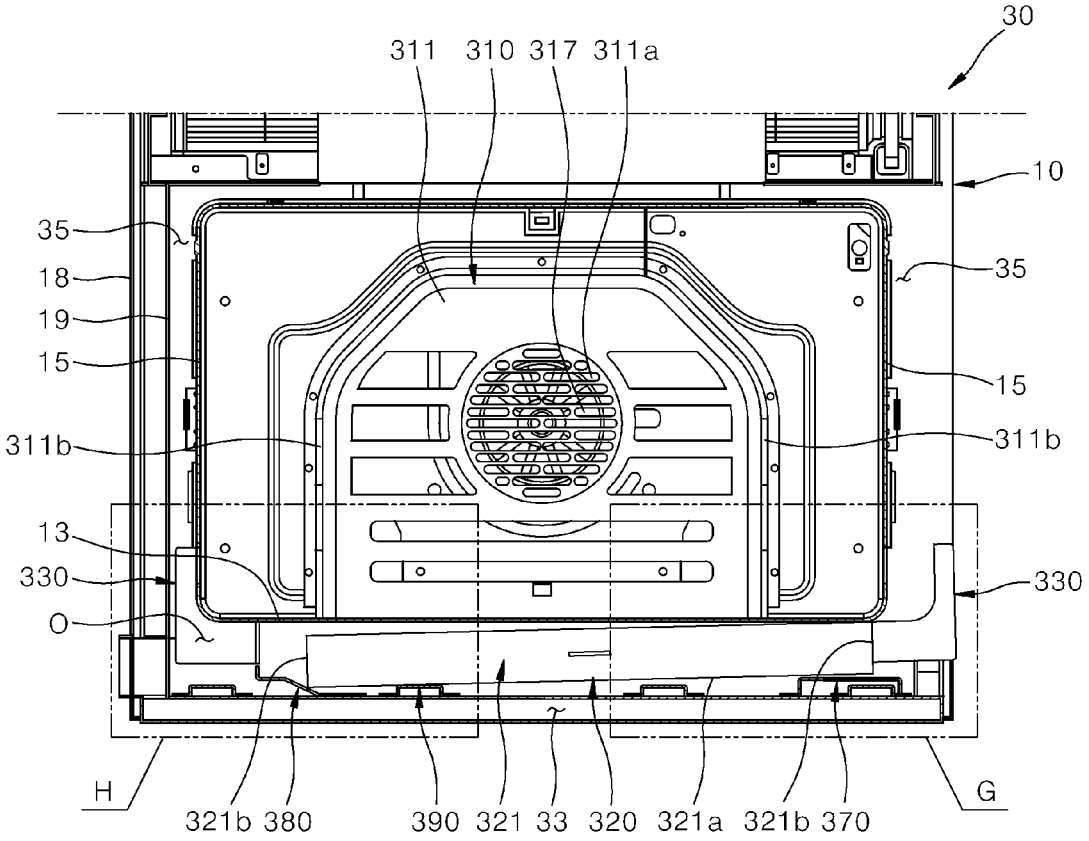
FIG. 15 is a sectional view illustrating a state in which the lower heating unit illustrated in FIG. 12 is partially withdrawn.
Figure 16:
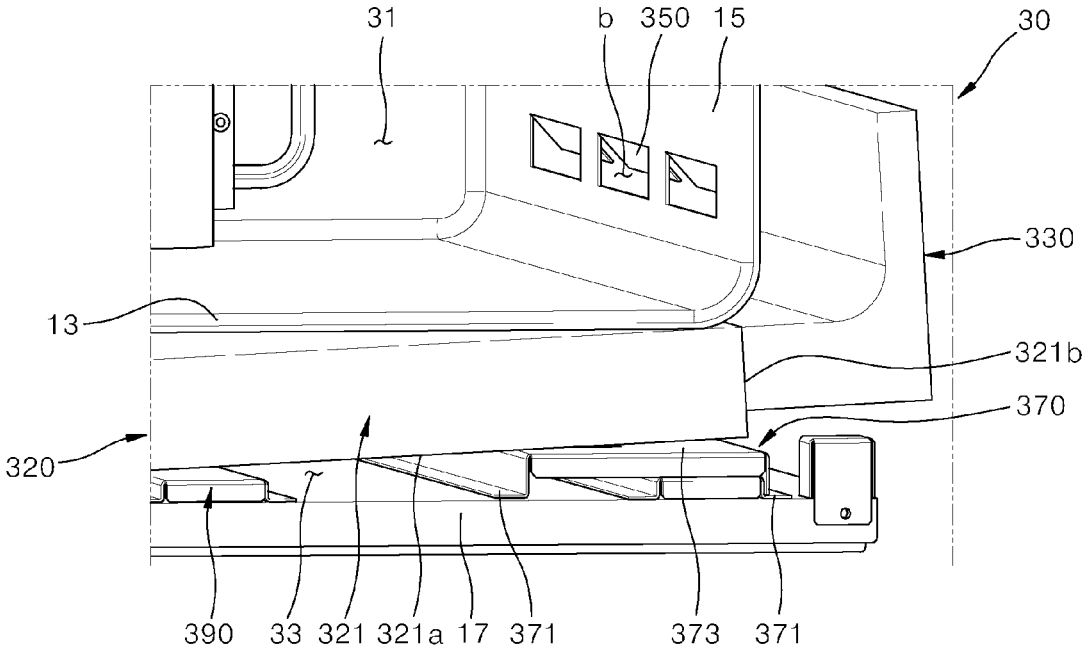
FIG. 16 is an enlarged cross-sectional view of a portion "G" in FIG. 15.
Figure 17:
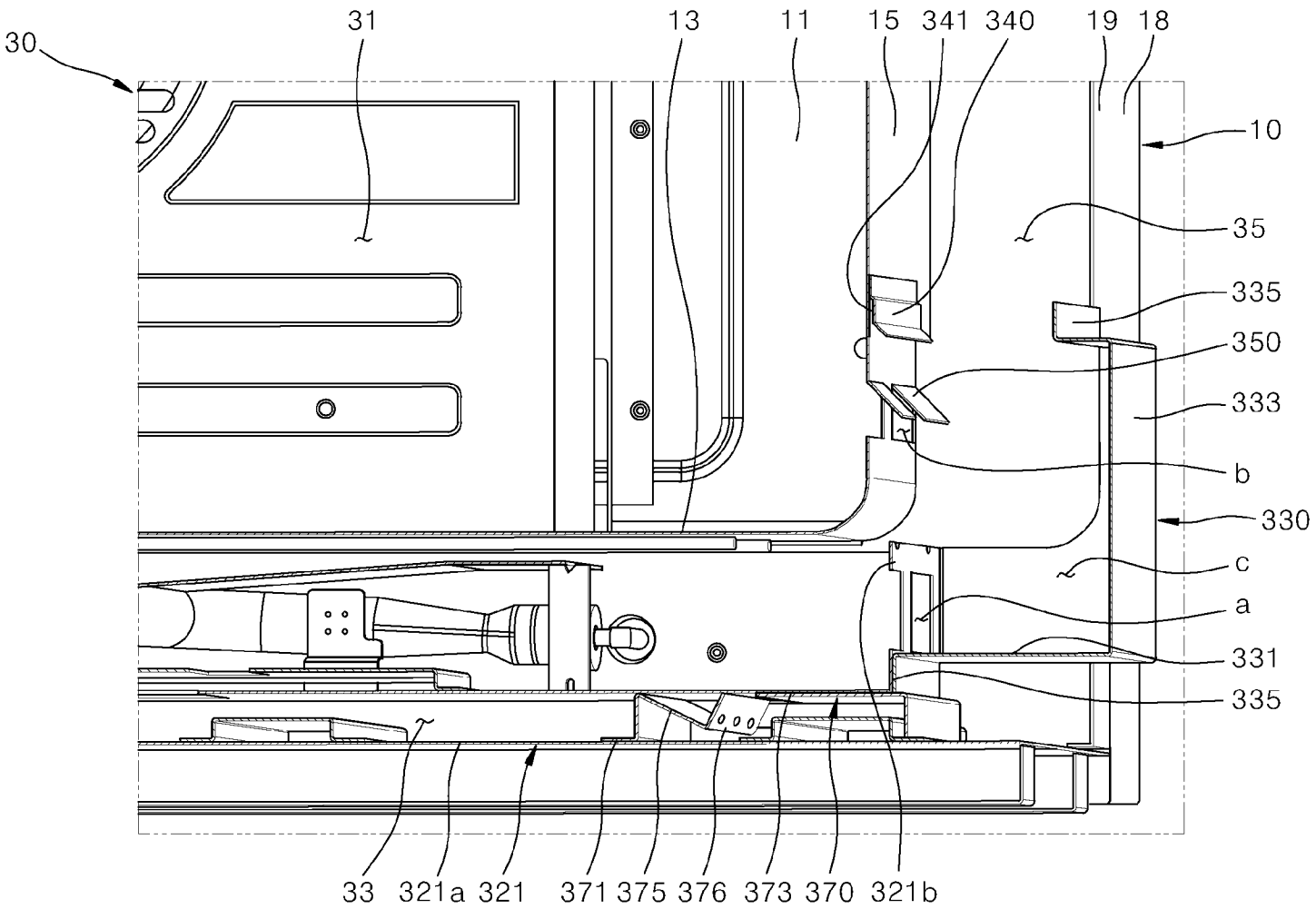
FIG. 17 is a cross-sectional view illustrating the portion "G" in FIG. 15, which is enlarged in another direction.
Figure 18:
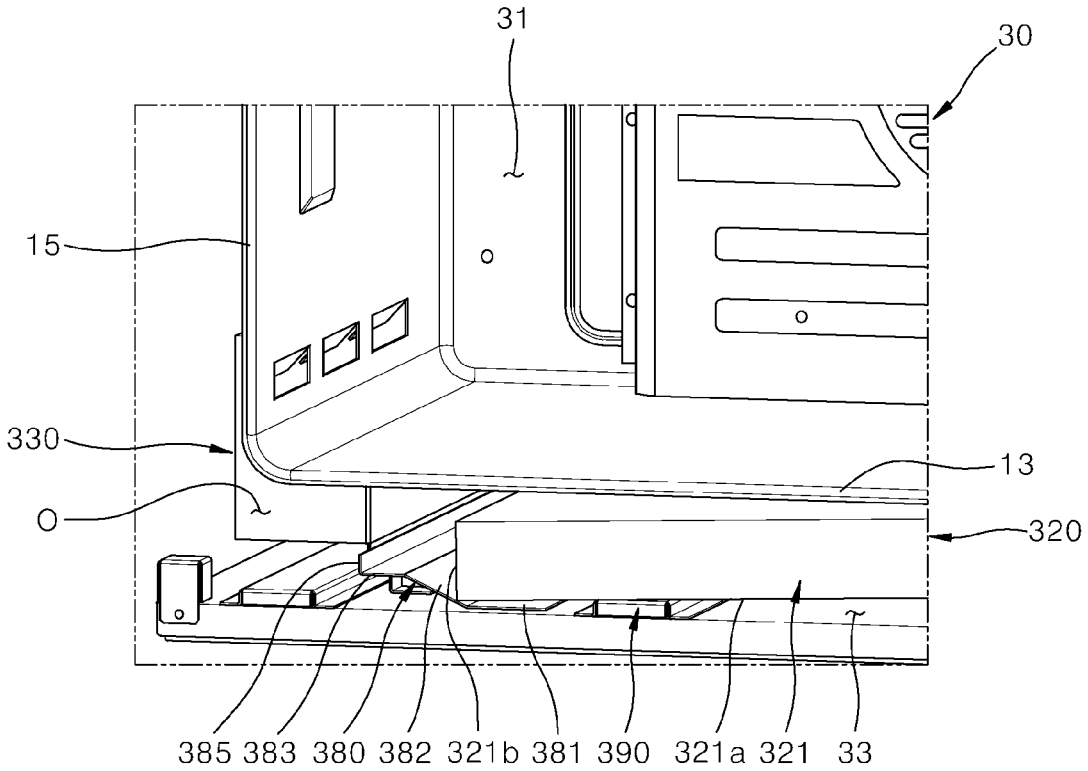
FIG. 18 is an enlarged cross-sectional view of a portion "H" in FIG. 15.
Figure 19:
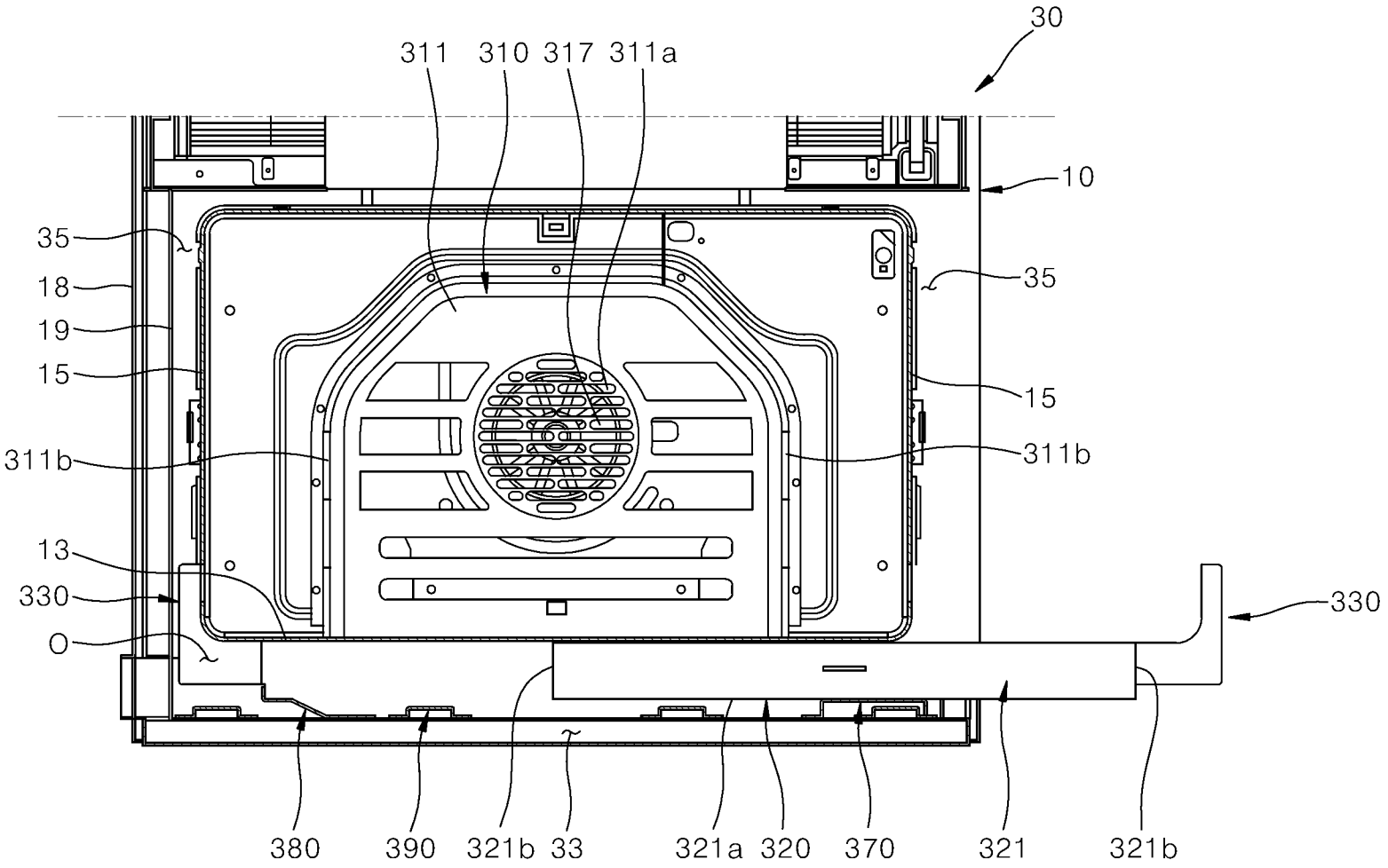
FIG. 19 is a cross-sectional view illustrating a state in which the lower heating unit illustrated in FIG. 15 is drawn out.

FIG. 15 is a sectional view illustrating a state in which the second heating assembly illustrated in FIG. 12 is partially withdrawn, FIG. 16 is an enlarged cross-sectional view of a portion "G" in FIG. 15, and FIG. 17 is a cross-sectional view illustrating the portion "G" in FIG. 15, which is enlarged in another direction. Also, FIG. 18 is an enlarged cross-sectional view of a portion "H" in FIG. 15, and FIG. 19 is a cross-sectional view illustrating a state in which the second heating assembly illustrated in FIG. 15 is drawn out.

Hereinafter, an installation structure capable of inserting and withdrawing the second heating assembly 320 according to the embodiment will be described with reference to FIGS. 10 to 19. Referring to FIG. 12, the second heating assembly 320 may be inserted into a lower space portion 33 and fixed to a set position, thereby being installed below the outer side of the cooking chamber 31. Hereinafter, an installation structure of the second heating assembly 320 installed at the set position will be described in detail.

Referring to FIGS. 10 to 13, a supporting structure formed by the first support 370, a coupling structure between the lower case 321 and the first flow path connection member 330, and a coupling structure between the first flow path connection member 330 and the left side surface 15 are located at the left portion of the lower case 321 that is inserted into the lower space portion 33 to be positioned at the set position.

First, referring to the supporting structure formed by the first support 370, a left bottom surface of the lower case 321 that is inserted to be positioned at the set position is supported by the first support panel 373 or the first connecting plate 376 of the first support 370 in the upward direction. Also, a left side wall 321*b* of the lower case 321 may be blocked by the stopping plate 375 configured to form a vertical blocking wall at the lateral outer side of the left side wall 321*b*, and thus movement of the lower case 321 installed at the set position toward the opening portion O may be prevented.

Next, referring to the coupling structure between the lower case 321 and the first flow path connection member 330, the first flow path connection member 330 may be positioned on the outer side in the lateral direction of the lower case 321. As a result, the path between the lower space portion 33 and the side space portion 35 for the second heating assembly 320 to be withdrawn laterally may be blocked by the first flow path connection member 330.

The coupling flange 335 formed at the lower end of the first flow path connection member 330 installed as described above, that is, at a lower edge portion of a first duct section 331, may be in a flat parallel to a left side wall 321*b*, and may be pressed against the left side wall 321*b*. In this case, the coupling flange 335 may be coupled to the first flow path connection member 330 and first support 370 by being forcibly inserted between the left side wall 321*b* and the stopping plate 375.

Accordingly, the coupling flange 335 may be forcedly inserted between the left side wall 321*b* and the stopping plate 375 so that a coupling structure in which three members are abutted against each other may be formed in the left side wall 321*b*. Therefore, in the coupling structure, a lower end portion of the first flow path connection member 330 may be detachably fixed between the left side wall 321*b* and the stopping plate 375 without being coupled by coupling members.

Only the left side wall 321*b* and the coupling flanges 335 may be fixedly coupled to each other by using the coupling member, and no coupling member used to fixedly couple the stopping plate 375 to the left side wall 321*b* and the stopping plate 375 to the coupling flange 335. When the lower case 321, the first support 370, and the first flow path connection member 330 are coupled as described above, the second heating assembly 320 may be withdrawn only by removing the stopping plate 375 without removing the coupling members and the heating assembly 320 may also be withdrawn by simply pulling the first flow path connection member 330.

As another example, when the left side wall 321*b*, the stopping plate 375, and the coupling flange 335 are abutted against each other, the fixed coupling between the lower case 321, the first support 370, and the first flow path connection member 330 may be performed in the left side wall 321*b* by coupling the three abutted members using the coupling members.

As still another example, the coupling between the first flow path connection member 330 and the left side wall 321*b* may further include a direct coupling between the coupling flange 335 and the left side wall 321*b* directly abutting each other at a position unrelated to that of the first support 370. For example, the coupling between the first flow path connection member 330 and the left side wall 321*b* may include a coupling structure in which the left side wall 321*b*, the stopping plate 375, and the coupling flange 335, which abut each other, are coupled to each other by forcibly insertion or using coupling members, and a coupling structure in which the coupling flange 335 and the left side wall 321*b* directly about each other are directly coupled to each other.

Referring to the coupling structure between the first flow path connection member 330 and the left side surface 15, a part of the coupling flange 335, more specifically the coupling flange 335 formed on the upper edge portion of the second duct section 333, may be detachably fixed to the side surface 15 by the clip 240. Also, the coupling flange 335 formed on the remaining edge portion of the second duct section 333 may receive a pressing force in a direction of close contact with the side surface 15 by the fixing of the upper and lower end portions of the first flow path connection member 330, and may be pressed against the side surface 15 without coupling by the coupling members.

In addition, the coupling between the first flow path connection member 330 and the left side surface 15 may include the coupling using coupling members. In this case, a degree of contact between the first flow path connection member 330 and the left side surface 15 may be improved, and thus the first flow path connection member 330 may be more stably coupled to the left side surface 15.

Referring to FIGS. 12 and 14, the supporting structure formed by the second support 380 and the coupling structure between the second flow path connection member 330*a* and the right side surface 15 may be located in or at a right portion of the lower case 321 that is inserted into the lower space portion 33 to be positioned at the set position. First, referring to the supporting structure formed by second support 380, a right bottom surface of the lower case 321 positioned at the set position may be supported by the second support panel 383 of the second support 380 in the upward direction.

Also, the right side wall 321*b* of the lower case 321 may be blocked by the second stopper 385 configured to form a vertical blocking wall at the lateral outer side of the right side wall 321*b*. As a result, the lower case 321 installed at the set position may be blocked from being moved toward the side facing the opening portion O, and thus a location of the lower case 321 pushed and inserted into the lower space portion 33 may be guided to the set position.

Next, referring to the coupling structure between the lower case 321 and the second flow path connection member 330*a*, the second flow path connection member 330*a* may be positioned on the outer side in the lateral direction of the lower case 321. As a result, the path between the lower space portion 33 and the side space portion 35 for the second heating assembly 320 to be withdrawn laterally may be blocked by the second flow path connection member 330*a*.

The coupling flange 335 formed at the lower end of the second flow path connection member 330*a* installed as described above, that is, at the lower edge portion of the first duct section 331, may be parallel to a right side wall 321*b*, and may be pressed against the right side wall 321*b*. In this case, the coupling flange 335 may be coupled to the second flow path connection member 330*a* and second support 380 by being forcibly inserted between the right side wall 321*b* and the second support panel 383.

The difference between the coupling structure between the right side wall 321*b* and the second flow path connection member 330*a* formed at the right portion of the lower case 321 and the coupling structure between the left side wall unit 321*b* and the first flow path connection member 330 formed at the left portion of the lower case 321 is that the lower case 321 and the second flow path connection member 330*a* may not be fixedly coupled. That is, the coupling flange 335 on the side of the lower end of the second flow path connection member 330*a* which abuts on the second stopper 385 may not be fixedly coupled to any one of the right side wall 321*b* and second stopper 385, nor fixedly coupled using the coupling members only to the second stopper 385 excluding the right side wall 321*b*.

Such a coupling structure is may take into consideration withdrawing the second heating assembly 320. When the right side wall 321*b*, that is, the right side surface of the lower case 321, and the second flow path connection member 330*a* are fixedly coupled to each other, both sides of the oven 30 may need to be open to withdraw the second heating assembly 320, and both the flow path connection members 330 and 330*a* installed on both sides of the oven 30 may need to be separated from the second heating assembly 320, and thus a withdrawing operation of the second heating assembly 320 may become more complicated, which has been taken into consideration for designing the coupling structure.

Referring to the coupling structure between the second flow path connection member 330*a* and the right side surface 15, a part of the coupling flanges 335, more specifically the coupling flange 335 (see FIG. 9) formed on the upper edge portion of the second duct section 333, may be detachably fixed to the side surface 15 by a clip member 340 (see FIG. 10). When the coupling flange 335 on the lower end side of the second flow path connection member 330*a* is fixedly coupled to the second stopper 385, the coupling flange 335 formed on the remaining edge portion of the second duct section 333 may receive a pressing force in a direction of close contact with the right side surface 15 by the fixing of the upper and lower end portions of the second flow path connection member 330*a*, and may be pressed against the side surface 15 without a coupling operation being performed.

An installation of the lower heating unit 320 and the second flow path connection member 330*a* may be performed in the following order. First, the second flow path connection member 330*a* may be installed on the right side of the oven 30, but initially, the upper end portion of the second flow path connection member 330*a* may need to be temporarily fixed by inserting the coupling flange 335 located at the upper end of the second flow path connection member 330*a* into the clip 340. A location of the second flow path connection member 330*a* in a vertical direction may be guided by the coupling between the clip 340 and the second flow path connection member 330*a*.

Next, the installation of the second flow path connection member 330*a* in the right portion of the oven 30 may be completed by fixing the members using coupling members in a state in which the coupling flange 335 located at the lower end portion of the second flow path connection member 330*a* is abutted against the second stopper 385. When the installation of the second flow path connection member 330*a* in the right portion of the oven 30 is completed, the second heating assembly 320 may be pushed in the lateral direction through the opening portion O to insert the second heating assembly 320 into the lower space portion 33.

At this time, the second heating assembly 320 may slide to a position at which the lower case 321 and the second connecting plate 382 are brought into contact with each other, and after passing through the contact point, the second heating assembly 320 may move to the second support panel 383 along an inclined surface formed at the second connecting plate 382. That is, the inclined second connecting plate 382 positioned on the sliding path of the second heating assembly 320 may guide movement of the second heating assembly 320 toward the second support panel 383 (see FIG. 18). When the second heating assembly 320 is inserted to the set position, interference may occur between the second stopper 385 and the right side wall 321*b*, and thus further sliding of the second heating assembly 320 may be blocked and the insertion of the second heating assembly 320 may be completed.

When the insertion of the second heating assembly 320 is completed as described above, the first flow path connection member 330 may be installed on the left side of the oven 30, but first, the upper end portion of the first flow path connection member 330 may need to be temporarily fixed by inserting the coupling flange 335 positioned at the upper end of the first flow path connection member 330 into the clip 340 as illustrated in FIGS. 10 to 13. A location of the first flow path connection member 330 in the vertical direction may be guided by the coupling between the clip 340 and the first flow path connection member 330.

When the upper end portion of the first flow path connection member 330 is temporarily fixed and the first flow path connection member 330 is guided in the vertical direction, the lower end portion of the first flow path connection member 330 is brought into close contact with the lower case 321 so that the left side wall 321*b*, the stopping plate 375, and the coupling flange 335 abut each other. Next, the left side wall 321*b*, the stopping plate 375, and the coupling flange 335 abutting each other may be fixed by using coupling members, and in the other location therefrom, the left side wall 321*b* and the coupling flange 335 directly abutting each other may be fixed by using coupling members, so that the installation of the lower case 321 and the first flow path connection member 330 in the left portion of the lower case 321 may be completed.

In this case, the lower case 321 and the second flow path connection member 330*a* may not be fixedly coupled to each other on the right side of the lower case 321. However, when the coupling between the left side wall 321*b* and the stopping plate 375 or the left side wall 321*b* and the first flow path connection member 330 at the left side of the lower case 321 is performed so that a pressing force is applied in a direction in which the right side wall 321*b* is in close contact with the second flow path connection member 330*a*, a degree of contact between the right side of the lower case 321 and the second flow path connection member 330*a* may be improved, and thus a leakage of heat through a gap between the right side of the lower case 321 and the second flow path connection member 330*a* may be suppressed.

The second heating assembly 320 installed as described above may be withdrawn in the following order. As illustrated in FIG. 15, the outer panel 18 and the gasket case 19 provided on the left side of the oven 30 may be separated from the main body 10 so that the side space portion 35 is open to the outside of the oven 30. Then, the upper end of the first flow path connection member 330 coupled with the clip 340 may be separated from the clip 340, thereby releasing the coupling between the first flow path connection member 330 and the left side surface 15.

As shown in FIGS. 15 to 17, the stopping plate 375 may then be pulled downward so that the obstacle blocking movement of the lower case 321 is removed, and then the lower case 321 may be pulled forward. When the lower case 321, the stopping plate 375, and the first flow path connection member 330 are fixedly coupled together by coupling members, the coupling therebetween may be released by releasing the coupling members therefrom.

Accordingly, as illustrated in FIG. 19, the second heating assembly 320 may move in a direction of withdrawal from the inside of the lower space portion 33 while the second heating assembly 320 is separated from the second flow path connection member 330*a* installed on the right side of the oven 30. When the second heating assembly 320 is fully removed from the inside of the oven 30, the withdrawal of the second heating assembly 320 may be complete.

When the coupling used to fix the first flow path connection member 330 to the lower case 321 is maintained regardless of the coupling between the first support 370 and the lower case 321 and the first flow path connection member 330 released in the previous process, the first flow path connection member 330 together with the second heating assembly 320 may be withdrawn from the inner portion of the oven 30 while being coupled to the second heating assembly 320.

In this case, the second heating assembly 320 may be easily withdrawn from the oven 30 only by pulling the first flow path connection member 330 exposed on the side space portion 35 without having to insert a hand deep into the oven unit 30 to grab the lower case 321, so that the second heating assembly 320 may be withdrawn more easily and conveniently.

In order to perform maintenance of the second heating assembly 320, conventionally, a configuration in the form of a detachable plate in which the lower surface 13 of the cooking chamber 31 is detachable from the cooking chamber 31 or a configuration in which the bottom panel 17 configured to form the bottom surface of the main body 10 is detachable from the main body 10 has been used. However, when the lower surface 13 of the cooking chamber 31 is formed in a plate shape which is detachable from the cooking chamber 31, the aesthetic appearance of the inside of the cooking appliance may be negatively affected and cleanliness may be negatively affected because foreign matter may collect in a gap therebetween.

Furthermore, there may be great difficulty in maintenance work in that the operator has to lean his or her body toward the inside of the cooking chamber 31 to withdraw the second heating assembly 320, or else work visibility cannot be attained. In a case in which the bottom panel 17 forming the bottom surface of the main body 10 is configured in a detachable form, the maintenance work of the second heating assembly 320 becomes possible only by turning over the cooking appliance, thus making maintenance very difficult, and creating a great possibility that the cooking appliance may be damaged in the process of turning the cooking appliance upside down or that an operator may be injured in an accident.

Therefore, the cooking appliance of the embodiment, without separating the lower surface unit of the cooking chamber 31 or turning the cooking appliance upside down, may provide an installation structure in which the second heating assembly 320 is configured to be inserted or withdrawn through the side portion of the cooking appliance as described above. The cooking appliance of the embodiment may make maintenance work for the second heating assembly 320 easy, quick, and convenient by allowing the second heating assembly 320 to be easily and conveniently withdrawn from the cooking appliance through the side thereof when repair or replacement of the lower heating unit 320 is required.

Also, the cooking appliance of the embodiment may smooth and flatten the bottom surface of the cooking chamber 31 to provide an improved aesthetic appearance as well as reduce the risk of breakdown of the cooking appliance and risk of accident occurrence during maintenance work by allowing the second heating assembly 320 to be inserted or withdrawn without separating the lower surface 13 of the cooking chamber 31 or turning the cooking appliance upside down.

Figure 20:
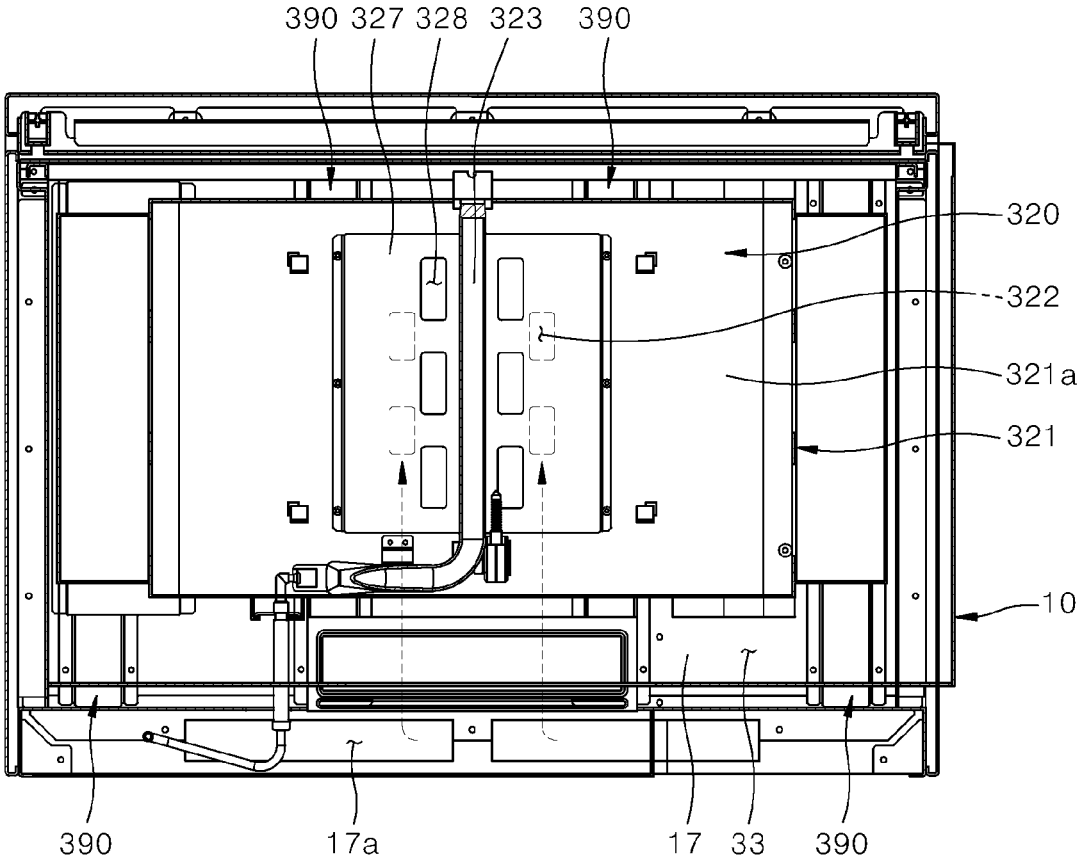
FIG. 20 is a cross-sectional view taken along line "XX-XX" in FIG. 1.

FIG. 20 is a cross-sectional view taken along line "I-I" in FIG. 1. Referring to FIGS. 5 and 20, the first heating assembly 310 may be installed on the rear side of a cooking chamber 31 and an air inflow hole 17*a* may be formed in or at the rear side of the bottom panel 17 adjacent to the rear side of the cooking chamber 31. The air inflow hole 17*a* may be formed vertically on the rear side of the bottom panel 17 and may form a path for introducing outside air into the first heating assembly 310.

Accordingly, the outside air may flow into the inside of the main body 10, more specifically into the lower space portion 33 through the air inflow hole 17*a*, and some of the outside air introduced into the lower space portion 33 may flow into the first heating assembly 310 through a hole formed in the rear side of the lower surface 13. The outside air introduced into the first heating assembly 310 may be used as secondary air to produce stable combustion in the first heater 313 (see FIG. 4) provided in the first heating assembly 310.

The remaining portion of the air introduced into the main body 10 through the air inflow hole 17*a* may flow inside the lower space portion 33. In addition, a plurality of flow guiding members or ducts 390 may be laterally spaced apart from each other at a bottom surface of the lower heating assembly 320, that is, between the bottom surface 321*a* and the bottom panel 17.

Each flow guiding duct 390 may be provided in the form of a side wall partitioning a space between the bottom surface of the lower heating assembly 320 and the bottom panel 17, that is, the lower space portion 33, in the lateral direction. Also, a flow path in the front-rear direction for connecting the air inflow holes 17*a* and the through holes 322, formed to pass through the bottom surface 321*a*, may be formed between the adjacent pair of flow guiding ducts 390.

The flow guiding ducts 390 installed as described above may guide some of the air flowing inside the lower space portion 33, among the outside air introduced through the air inflow hole 17*a*, to the through hole 322 located in front of the air inflow hole 17*a* by forming a flow path in the front-rear direction for connecting the through hole 322 and the air inflow hole 17*a*. As a result, the supply of the secondary air for stable combustion in the lower heater 323 provided in the lower heating assembly 320 may be promoted, so that the combustion stability of the lower heating assembly 320 can be improved. Further, the flow guiding ducts 390 installed as described above may improve durability of the bottom panel 17 and may act to suppress an occurrence of twisting of the bottom panel 17 by acting as a structure coupled to the bottom panel 17 to increase the strength of the bottom panel 17.

Figure 21:
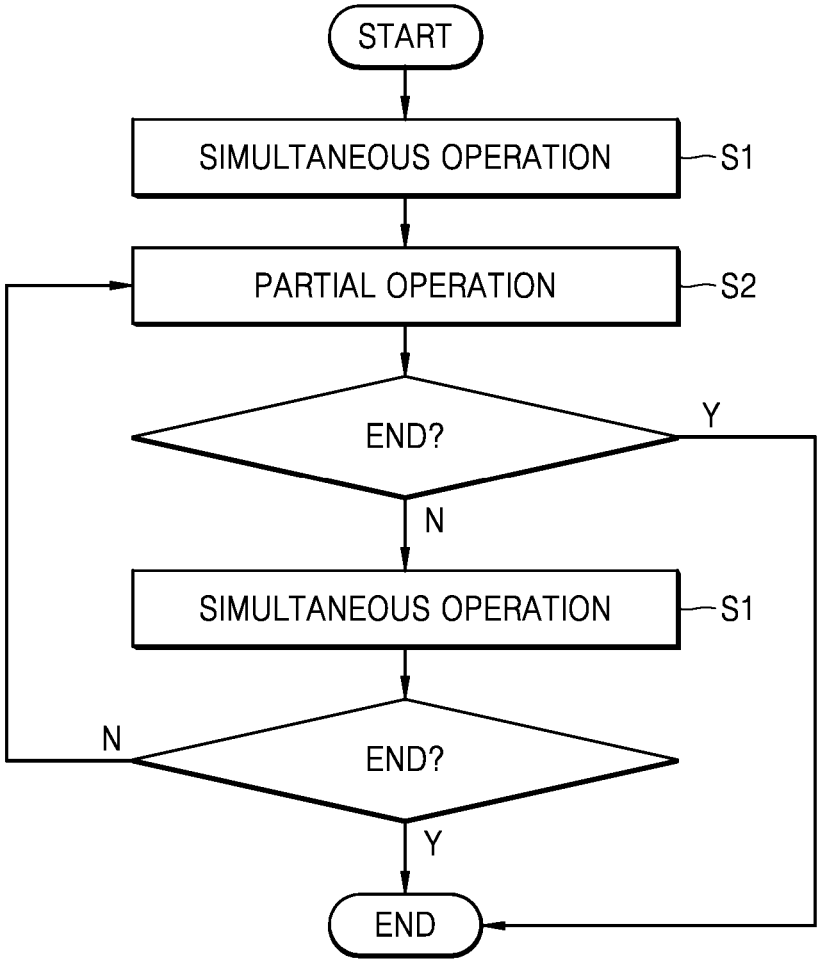
FIG. 21 is a flowchart illustrating an example of a process of controlling combustion in a cooking appliance according to an embodiment.
Figure 22:
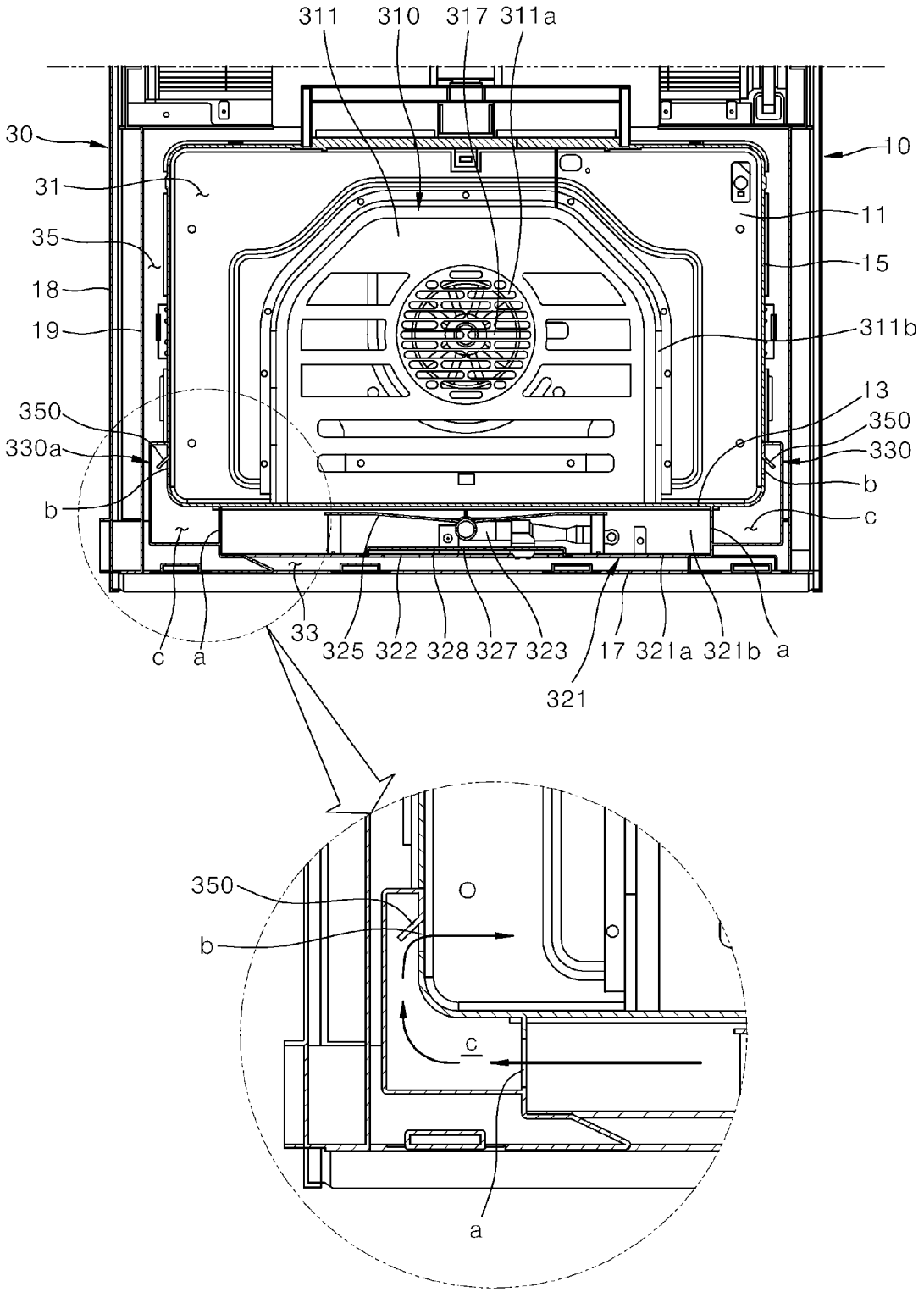
FIG. 22 illustrates an example of a flow of heat formed inside the cooking appliance according to an embodiment.

FIG. 21 is a flowchart illustrating an example of a process of controlling combustion in a cooking appliance according to an embodiment. FIG. 22 illustrates an example of a flow of heat formed inside the cooking appliance according to an embodiment. Hereinafter, a method of controlling combustion of a cooking appliance according to the embodiment will be described with reference to FIGS. 21 and 22.

As described above, the oven 30 of the embodiment may have two heating assemblies therein, the first heating assembly 310 installed inside the cooking chamber 31, which is one of the two heating assemblies, which may generate a circulation flow of heat circulating inside the cooking chamber 31, and the second heating assembly 320, which is a second assembly and may generate heat from below the cooking chamber 31. The cooking appliance of the embodiment having the above two heating assemblies may be operated in the following manner.

First, a simultaneous operation step S1 to simultaneously operate the first heating assembly 310 and the second heating assembly 320 may be performed in an initial state in which no heating has been performed in a cooking chamber 31. In the simultaneous operation step S1, combustion of the first heater 313 and combustion of the second heater 323 may be simultaneously performed. Accordingly, in the cooking chamber 31, a circulation flow of heat may be generated so that heat is circulated in the cooking chamber 31 by an operation of the first heating assembly 310, and at the same time, a flow of the heat is also generated so that heat generated by an operation of the second heating assembly 320 is discharged from the side portion of the cooking chamber 31 through a flow path guide c formed inside the flow path connection members 330 and 330*a*.

In this case, the heat discharged through the side portion of the cooking chamber 31, that is, through the second discharge port b, may combine with the flow of the heat generated by the operation of the first heating assembly 310, that is, the circulation flow of the heat circulating inside the cooking chamber 31. Thus, the heat generated by a combustion operation of the first heating assembly 310 and the heat generated by a combustion operation of the second heating assembly 320 may be combined and circulated inside the cooking chamber 31, so that a temperature in the cooking chamber 31 may be raised more quickly. That is, by using an operation control of simultaneously operating the first heating assembly 310 and the second heating assembly 320, the cooking appliance of the embodiment may quickly raise the temperature in the cooking chamber 31, thereby allowing the initial preheating of the cooking chamber 31 to be performed more quickly and effectively, and shortening the time required for cooking food.

A second discharge port b configured to form a path on the cooking chamber 31 to discharge the heat generated by the combustion operation of the second heating assembly 320 may be formed on the side surface 15 and on the lower portion adjacent to the bottom surface of the cooking chamber 31. Accordingly, the heat generated by the second heating assembly 320 may be discharged into the cooking chamber 31 through the side portion of the cooking chamber 31 and discharged from the lower portion adjacent to the bottom surface of the cooking chamber 31 into the cooking chamber 31.

The above-described discharged heat may be combined with the circulation flow of the heat circulating inside the cooking chamber 31, and circulated in the entire cooking chamber 31. However, the heat discharged from the second heating assembly 320 may first flow along the bottom surface of the cooking chamber 31 before the discharged heat merges with the circulation flow of the heat circulating inside the cooking chamber 31, that is, the heat may flow along the bottom surface of the cooking chamber 31 immediately after being discharged into the cooking chamber 31 through the second discharge port b.

Therefore, the flow of heat flowing along the bottom surface of the cooking chamber 31 may be applied to food placed in the cooking chamber 31 together with the circulation flow of the heat circulating inside the entire cooking chamber 31. Thus, in addition to the heat circulating inside the entire cooking chamber 31, the heat flowing along the bottom surface of the cooking chamber 31 may be added to the bottom surface of the food. Furthermore, on the bottom surface of the food, not only the heat discharged through the second discharge port b but also heat transferred by convection through the bottom surface of the cooking chamber 31, that is, through the bottom surface heated by the combustion of the second heater 323, may be additionally transferred.

Thus, concentrated heating may be achieved so that a relatively high amount of heat is applied to the bottom surface of the food in comparison with that applied to other portions of the food. That is, by using the operation control of simultaneously operating the first heating assembly 310 and the second heating assembly 320, the cooking appliance of the embodiment may provide not only a function of rapidly raising a temperature in the cooking chamber 31 while uniformly heating the entire cooking chamber 31 but also a function of concentrated heating on a bottom surface of food.

After the above-described simultaneous operation or step S1 proceeds to a point set by the simultaneous operation or step S1, a partial operation or step S2 may be performed so that only one of the first heating assembly 310 and the second heating assembly 320 is operated. As an example, the partial operation step or S2 may be performed so that only the first heating assembly 310 is operated. Accordingly, in the cooking chamber 31, heating in which only the circulation flow of the heat circulating inside the cooking chamber 31 is generated by the operation of the first heating assembly 310 may be performed, and heating in which the heat generated by the second heating assembly 320 is discharged through the side portion of the cooking chamber 31 may be stopped.

The partial operation or step S2 may be selected when preparing a food that does not require concentrated heating on the bottom surface of the food but is still necessary to uniformly cook the entire food. That is, the cooking appliance according to the embodiment may cook the food so that the simultaneous operation or step S1 is first performed to quickly raise the temperature in the cooking chamber 31 to a temperature suitable for cooking the food and then the partial operation or step S2 is performed so that only the first heating assembly 310 is operated. Thus, the entire food item may be uniformly heated and cooked while effectively shortening the time required for cooking the food.

As another example, the partial operation or step S2 may be performed so that only the second heating assembly 320 is operated. Accordingly, in the cooking chamber 31, only heating in which the heat generated in the second heating assembly 320 is discharged through the side portion of the cooking chamber 31 is performed, and heating by the operation of the first heating assembly 310 is stopped. The partial operation or step S2 performed as described above may be used when cooking food, such as a pizza, that requires concentrated heating on the bottom surface of the food.

That is, the cooking appliance according to the embodiment may cook the food so that the simultaneous operation or step S1 is first performed to quickly raise the temperature in the cooking chamber 31 to a temperature suitable for cooking the food and then the partial operation or step S2 is performed to operate only the lower heating unit 320 when a temperature in the cooking chamber 31 required for cooking food is maintained for some time. Thus, a function of applying concentrated heating to the bottom surface of the food may be more effectively provided so that the bottom surface of the food, such as pizza, can be cooked to be more crispy.

Also, during a simultaneous operation of the first heating assembly 310 and the second heating assembly 320, airflow formed by the operation of the convection fan 317 may affect combustion of the second heater 323, and thus a problem may occur in that that combustion in the second heater 323 may become unstable; for example, a flame formed in the second heater 323 may shake or complete combustion in the second heater 323 may not be suitably performed. The cooking appliance of the embodiment may switch the combustion operation to the partial operation or step S2 when the combustion of the second heater 323 becomes unstable while the simultaneous operation or step S1 is performed, thereby stopping the operation of the first heating assembly 310 and allowing only the operation of the second heating assembly 320 to proceed.

Thus, the cooking appliance may prevent the airflow formed by the operation of the convection fan 317 from affecting the combustion of the second heater 323 and, thereby the combustion of the second heater 323 may be stabilized. Thus, the cooking appliance may prevent degradation in heating performance of the cooking appliance.

As another example, in the partial operation or step S2, the operation of the first heating assembly 310 and the operation of the second heating assembly 320 may be alternately performed. In the partial operation or step S2 operated as described above, a process in which an operation of one assembly of the first heating assembly 310 and the second heating assembly 320 is first performed and then an operation of the other assembly is performed, may be repeatedly performed.

In the cooking appliance according to the embodiment in which the partial operation or step S2 is performed as described above, a uniform heating function for an entire food item and concentrated heating function for a part of the food item may be effectively provided at the same time while the operation of the first heating assembly 310 may minimally affect the combustion of the second heating assembly 320. As another example, in the cooking appliance of the embodiment, the operation control of the first heating assembly 310 and the second heating assembly 320 may be performed so that the simultaneous operation or step S1 and the partial operation step or S2 are alternately performed.

Accordingly, the inside of the cooking chamber 31 may be heated so that the partial operation step S2 proceeds after the simultaneous operation or step S1 has proceeded for a set time, and the process of alternately performing the simultaneous operation or step S1 and the partial operation or step S2 may be repeatedly performed. The control of operating the first heating assembly 310 and the second heating assembly 320 may be performed so that the point in time when the simultaneous operation or step S1 switches to the partial operation or step S2 may be dependent on the temperature inside the cooking chamber 31.

For example, the control of operating the first heating assembly 310 and the second heating assembly 320 may be performed so that the partial operation or step S2 may be performed when the temperature inside the cooking chamber 31 reaches a set temperature while the simultaneous operation or step S1 is performed.

When the combustion operation of the cooking appliance is controlled as described above, the simultaneous operation or step S1 may be performed to quickly raise the temperature of the cooking chamber 31 to the set temperature, and the partial operation or step S2 may be performed to change the temperature of the cooking chamber 31 so that unnecessary consumption of energy can be reduced. Thus, it may be possible to effectively reduce the time required for cooking food while reducing the unnecessary consumption of energy.

Also, when the partial operation or step S2 is performed so that the operation of the first heating assembly 310 is stopped and only the operation of the second heating assembly 320 is performed, the second heater 323 may burn stably. The combustion control method of the cooking appliance according to the embodiment may not only effectively shorten the time required for cooking while reducing unnecessary consumption of energy, but may also have an effect of providing a uniform heating function that uniformly cooks an entire food item by heating the entire cooking chamber 31 uniformly together with a function of applying concentrated heating to the bottom surface of the food.

The cooking appliance according to embodiments may make maintenance work for a lower heating assembly easy, quick, and convenient by allowing the lower heating assembly to be easily and conveniently withdrawn from the cooking appliance through a side thereof when repair or replacement of the lower heating assembly required. Also, the cooking appliance according to embodiments may make a bottom surface of a cooking chamber smooth and flat to provide an improved aesthetic appearance as well as reduce the risk of breakdown of the cooking appliance and risk of an accident occurring during maintenance work by allowing a lower heating assembly to be inserted or withdrawn without separating the lower surface of the cooking chamber or turning the cooking appliance upside down.

A cooking appliance according to embodiments may include a main body having a cooking chamber formed therein, a lower space portion formed inside the main body to form a space separated from the cooking chamber between a bottom of the main body and the cooking chamber, and first and second heating assemblies, the second heating assembly being installed inside the lower space portion, wherein an opening portion configured to open the lower space portion to an outside of the main body is formed in the lower space portion between the bottom of the main body and the cooking chamber, and the second heating assembly is inserted into or withdrawn from the lower space portion through the opening portion. The second heating assembly may include a heater configured to generate heat; and a case having the second lower heating assembly installed therein and slidably inserted into the lower space portion from the outside of the main body through the opening portion.

The main body may further include a side space portion formed at a side portion of the main body to form a space separated from the cooking chamber beside the cooking chamber, the opening portion may be formed between the lower space portion and the side space portion to form a path connecting the lower space portion and the side space portion, and the lower case may be installed to be slidable in a lateral direction in the lower space portion. The lower case may include a bottom surface configured to form a bottom surface of the lower case, and a side wall extending upward from the bottom surface to form a side surface of the lower case, wherein the side wall may be coupled to the main body to be slidable in the lateral direction while preventing the lower case from moving in the front-rear direction.

The main body may further include a guide protrusion that protrudes toward the lower case from a lower boundary surface of the cooking chamber and extends in the lateral direction, wherein a guide groove into which the guide protrusion is inserted is concavely formed in a shape corresponding to the shape of the guide protrusion in the upper end of the side wall, and the lower case is coupled to the guide protrusion to be slidable by the guide protrusion and the side wall which are engaged. The main body may include a rear surface configured to define a rear boundary surface of the cooking chamber, a lower surface configured to define a lower boundary surface of the cooking chamber, and a side surface configured to define a side boundary surface of the cooking chamber, wherein the lower surface is integrally formed to be connected to at least one of the rear surface and the side surface, and partitions the cooking chamber and the lower space portion.

The lower case may include a bottom surface configured to form a bottom surface of the lower case, a side wall extending upward from the bottom surface to form a side surface of the lower case, and a contact surface configured to form a contact surface with the lower surface, wherein the contact surface is bent at the upper end portion of the side wall to form a flat surface parallel to the lower surface. The lower case may include the bottom surface configured to form the bottom surface of the lower case, the side wall extending upward from the bottom surface to form the side surface of the lower case, and a first discharge port configured to form a path through an inside of the lower case open to the outside of the main body, in the side wall portion, wherein a second discharge port is formed in the side surface to form a path through which the inside of the cooking chamber is open to the outside of the main body. The cooking appliance may further include a flow path connection member detachably coupled to the main body and the lower case to form a flow path guide connecting the first discharge port and the second discharge port.

The lower case may include the bottom surface configured to form the bottom surface of the lower case, and a plurality of side walls extending upward from the bottom surface to form the side surface of the lower case. The first discharge port may be formed in each of the side wall disposed at the opening portion and the side wall disposed to face the opening portion. The second discharge ports may be formed in each of a pair of the side surfaces facing each other. The flow path connection member may include a first flow path connection member disposed on the opening portion to form the flow path guide and a second flow path connection member disposed to face the opening portion to form the flow path guide.

The first flow path connection member on the opening portion may be fixedly coupled to each of the side surface and the side wall to fix the lower case to the main body. The second flow path connection member facing the opening portion may be fixedly coupled to the side surface and may be in contact with and detachable from the side wall.

The flow path connection member may include a duct section provided outside the cooking chamber to form an outer wall surrounding the flow path guide from an outside of the flow path guide, and a coupling flange that couples the duct section to at least one of the lower case and the side surface, wherein the flow path guide forms a path connecting the first discharge port and the second discharge port in a space surrounded by the duct section. The coupling flange may protrude from the edge of the duct section abutting the side surface or the side surface of the lower case, and more specifically, may be formed to be parallel to the side surface or the side surface of the lower case so as to be in surface contact with the side surface or the lower case.

The cooking appliance may further include a clip provided on an outer side of the side surface to press the coupling flange toward the side surface so that the coupling flange pressed against the side surface. An insertion groove of which the upper portion is closed and the lower portion is open may be formed between the side surface and the clip.

The clip may be coupled to the side surface such that the upper portion of the insertion groove is disposed on the upper portion of the second discharge port. The upper end portion of the coupling flange inserted into the insertion groove may be interfered with by the upper portion of the insertion groove, so that the vertical positioning of the flow path connection member coupled to the side surface is guided.

The main body may further include a side space portion formed at a side portion of the main body to form a space separated from the cooking chamber beside the cooking chamber. The opening portion may be formed between the lower space portion and the side space portion to form a path connecting the lower space portion and the side space portion. The lower case may be installed to be slidable in a lateral direction inside the lower space portion and may be withdrawn from the lower space portion through the opening portion and the side space portion. When the lower case is withdrawn from the main body, the first flow path connection member together with the lower case may be separated from the main body.

The main body may further include a side panel which is coupled to and detachable from a side portion of the main body to cover the side space portion. The main body may include a bottom panel configured to define the lower boundary surface of the lower space portion. Supports may be provided on the bottom panel to support the lower case so that a lower case inserted into the lower space portion is disposed at a set position.

The supports may include a first support at the opening portion which blocks the lower case installed in the set position from moving in the withdrawing direction and supports the lower case, and a second support facing the opening portion which blocks movement of the lower case installed at the set position from moving in the insertion direction and supports the lower case. The first support may include a first support flange coupled with the bottom panel, a first support panel connected to the first support flange to support the bottom surface of the lower case from below at a position spaced upward from the bottom panel, and a first stopper protruding upward from the first support panel to interfere with a side portion of the opening portion of the lower case positioned at the set position.

The first stopper may include a stopping plate formed to protrude upward from the first support panel, and a first connecting plate connected to the first support panel to be elastically deformable in a vertical direction to connect the stopping plate to the first support panel. A part of the first support panel may be incised to form the connecting plate and a part of the connecting plate may be bent upward to form the stopping plate.

The second support may include a second support flange coupled with the bottom panel; a second connecting plate extending upward from the second support flange; and a second support panel formed to extend from the second connecting plate in the insertion direction of the lower case and supporting the bottom surface of the lower case at a position spaced upwardly from the bottom panel. The second support may further include a second stopper protruding upward from the second support panel to interfere with a side portion facing the opening portion of the lower case located at the set position.

The second connecting plate may form an inclined surface inclined upward in the inserting direction of the lower case, and may connect the second support flange and the second support panel.

The second connecting plate may be connected to the second support flange to be elastically deformable in the vertical direction to elastically support the second support panel.

The main body may further include the first heating assembly provided inside the cooking chamber to generate a circulation flow of the heat circulating inside the cooking chamber. The first heating assembly may be installed behind the cooking chamber, and an air inflow hole may be formed in a rear side of the bottom unit adjacent to a rear side of the cooking chamber to form a path to introduce outside air into the first heating assembly. Through holes may be formed in a bottom surface of the lower case to form a path for introducing outside air into the lower case, and a flow guiding member may be provided between the bottom surface of the lower case and the bottom panel to guide a flow of outside air introduced through the air inflow hole toward the through holes located in front of the air inflow hole.

The flow guiding member may be provided in the form of the side wall that laterally partitions a space between the bottom surface of the lower case and the bottom panel. A plurality of the flow guiding members may be installed at a predetermined distance in the lateral direction between the bottom surface of the lower case and the bottom panel. A flow path in the front-rear direction connecting between the air inflow hole and the through-hole may be formed between a pair of adjacent flow guiding members.

While the above disclosure has been described with reference to the exemplary embodiments illustrated in the accompanying drawings, it should be understood that embodiments are not limited to the disclosed embodiments, but is intended to cover various modifications and equivalent arrangements included within the sprit and scope of the appended claims. Accordingly, the scope shall be determined only according to the attached claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking appliance comprising:

a main body having a cooking chamber formed therein;

a lower space formed inside the main body and separated from the cooking chamber between a bottom of the main body and the cooking chamber;

first and second heating assemblies, the second heating assembly configured to be installed inside the lower space, wherein an opening from the lower space to an outside of the main body is formed between the bottom of the main body and the cooking chamber, and the second heating assembly is inserted into or withdrawn from the lower space through the opening, wherein the second heating assembly includes:

a heater configured to generate heat; and a lower case having the second heating assembly installed therein and slidably inserted into the lower space from the outside of the main body through the opening, wherein the main body includes:

a rear surface configured to define a rear boundary of the cooking chamber;

a lower surface configured to define a lower boundary of the cooking chamber; and a side surface configured to define a side boundary of the cooking chamber, wherein the lower surface is integrally formed to be connected to at least one of the rear surface or the side surface and partitions the cooking chamber and the lower space, wherein the lower case includes:

a bottom surface; and at least one side wall configured to extend upward from the bottom surface;

a plurality of first discharge ports configured to form a first path in the at least one side wall, through which an inside of the lower case is open to the outside of the main body; and a plurality of second discharge ports formed in the side surface to form a second path through which an inside of the cooking chamber is open to the outside of the main body, wherein the cooking appliance further includes a flow path connection member detachably coupled to the main body and the lower case to form a flow path guide connecting the plurality of first discharge ports and the plurality of second discharge ports, and wherein:

the at least one side wall includes a plurality of side walls configured to extend upward from the bottom surface;

the plurality of first discharge ports is formed in each side wall of the plurality of side walls disposed at the opening and the side wall disposed to face the opening;

the plurality of second discharge ports is formed in each of a pair of the side surfaces facing each other; and the flow path connection member includes a first flow path connection member provided at the opening to form the flow path guide and a second flow path connection member arranged to face the opening to form the flow path guide, wherein the first flow path connection member is fixedly coupled to at least one side surface of the plurality of side surfaces to fix the lower case to the main body, and the second flow path connection member facing the opening is fixedly coupled to the side wall facing the opening and is in contact with and detachable from the side surface facing the opening.

2. The cooking appliance of claim 1, wherein:

the main body further includes a side space formed at a side of the main body and separated from the cooking chamber;

the opening is formed between the lower space and the side space to form a path connecting the lower space and the side space; and the lower case is configured to be slidable in a lateral direction in the lower space.

3. The cooking appliance of claim 2, wherein the plurality of side walls is coupled to the main body and configured to be slidable in the lateral direction while preventing the lower case from moving in a frontward-rearward directions.

4. The cooking appliance of claim 1, wherein the flow path connection member includes:

duct sections provided outside the cooking chamber to form an outer wall surrounding the flow path guide from an outside of the flow path guide; and a coupling flange configured to couple the duct sections to at least one of the side wall of the lower case or the side surface, wherein the coupling flange protrudes from edges of the duct sections abutting the side surface or the side wall of the lower case and is parallel to the side surface or the side wall of the lower case so as to be in surface contact with the side surface or the side wall of the lower case, and the flow path guide forms a path connecting the first discharge port and the second discharge port in a space surrounded by the duct sections.

5. The cooking appliance of claim 1, wherein:

the main body further includes a side space formed at a side of the main body and separated from the cooking chamber;

the opening is formed between the lower space and the side space to form a path connecting the lower space and the side space;

the lower case is configured to be slidable in a lateral direction inside the lower space;

the lower case is configured to be slidable in the lateral direction in the lower space and withdrawn from the lower space through the opening and the side space; and when the lower case is withdrawn from the main body, the first flow path connection member together with the lower case are separated from the main body.

6. The cooking appliance of claim 1, wherein:

the main body includes a bottom panel configured to define a lower boundary of the lower space; and supports are provided on the bottom panel to support the lower case so that the lower case inserted into the lower space is located at a set position.

7. The cooking appliance of claim 6, wherein the supports include:

a first support at the opening, which supports the lower case and blocks the lower case installed at the set position from moving in a withdrawing direction; and a second support facing the opening which supports the lower case and blocks movement of the lower case installed at the set position from moving in an insertion direction.

8. The cooking appliance of claim 7, wherein the first support includes:

a support flange coupled to the bottom panel;

a support panel connected to the support flange to support the bottom surface of the lower case from below at a position spaced upwardly from the bottom panel; and stoppers configured to protrude upward from the support panel to interfere with a side of the opening of the lower case positioned at the set position.

9. The cooking appliance of claim 7, wherein the second support includes:

a support flange coupled to the bottom panel;

a connecting plate configured to extend upward from the support flange;

a support panel that extends from the connecting plate in an inserting direction of the lower case and is configured to support the bottom surface of the lower case from below at a position spaced upwardly from the bottom panel; and a stopper configured to protrude upward from the support panel to interfere with a side portion of the lower case facing the opening portion located at the set position.

10. The cooking appliance of claim 6, wherein the first heating assembly is provided inside the cooking chamber and configured to generate a circulation flow of heat circulating inside the cooking chamber.

11. A cooking appliance comprising:

a main body having a cooking chamber formed therein;

a lower space formed inside the main body and separated from the cooking chamber between a bottom of the main body and the cooking chamber; and first and second heating assemblies, the second heating assembly configured to be installed inside the lower space, wherein an opening from the lower space to an outside of the main body is formed between the bottom of the main body and the cooking chamber, and the second heating assembly is inserted into or withdrawn from the lower space through the opening, wherein the second heating assembly includes:

a heater configured to generate heat; and a lower case having the second heating assembly installed therein and slidably inserted into the lower space from the outside of the main body through the opening, wherein:

the main body includes a bottom panel configured to define a lower boundary of the lower space; and supports are provided on the bottom panel to support the lower case so that the lower case inserted into the lower space is located at a set position, wherein the first heating assembly is provided inside the cooking chamber and configured to generate a circulation flow of heat circulating inside the cooking chamber, wherein:

the first heating assembly is installed at a rear side of the cooking chamber;

an air inflow hole is formed at a rear side of the bottom panel adjacent to the rear side of the cooking chamber to form a path to introduce outside air into the first heating assembly;

a through hole is formed in a bottom surface of the lower case to form a path to introduce outside air into the lower case; and a flow guiding duct is provided between the bottom surface of the lower case and the bottom panel to guide a flow of outside air introduced through the air inflow hole toward the through hole in front of the air inflow hole.

12. A cooking appliance, comprising:

a main body having a cooking chamber formed therein;

a lower space formed inside the main body and separated from the cooking chamber between a bottom of the main body and the cooking chamber; and first and second heating assemblies, the first heating assembly including a first heater and a convection fan and the second heating assembly including a second heater provided in a case, wherein the second heating assembly is configured to be installed inside the lower space, wherein an opening from the lower space to an outside of the main body is formed between the bottom of the main body and the cooking chamber, and the second heating assembly is inserted into or withdrawn from the lower space through the opening, wherein the second heating assembly includes:

the second heater configured to generate heat; and a lower case having the second heating assembly installed therein and slidably inserted into the lower space from the outside of the main body through the opening, wherein the main body includes:

a rear surface configured to define a rear boundary of the cooking chamber;

a lower surface configured to define a lower boundary of the cooking chamber; and a side surface configured to define a side boundary of the cooking chamber, wherein the lower surface is integrally formed to be connected to at least one of the rear surface or the side surface and partitions the cooking chamber and the lower space, wherein the lower case includes:

a bottom surface;

at least one side wall configured to extend upward from the bottom surface;

a plurality of first discharge ports configured to form a first path in the at least one side wall, through which an inside of the lower case is open to the outside of the main body; and a plurality of second discharge ports formed in the side surface to form a second path through which an inside of the cooking chamber is open to the outside of the main body, wherein the cooking appliance further includes a flow path connection member detachably coupled to the main body and the lower case to form a flow path guide connecting the plurality of first discharge ports and the plurality of second discharge ports, and wherein:

the at least one side wall includes a plurality of side walls configured to extend upward from the bottom surface;

the plurality of first discharge ports is formed in each side wall of the plurality of side walls disposed at the opening and the side wall disposed to face the opening;

the plurality of second discharge ports is formed in each of a pair of the side surfaces facing each other; and the flow path connection member includes a first flow path connection member provided at the opening to form the flow path guide and a second flow path connection member arranged to face the opening to form the flow path guide, wherein the first flow path connection member is fixedly coupled to at least one side surface of the plurality of side surfaces to fix the lower case to the main body, and the second flow path connection member facing the opening is fixedly coupled to the side wall facing the opening and is in contact with and detachable from the side surface facing the opening.

13. The cooking appliance of claim 12, further including:

a first support provided under the lower case and configured to support a first side of the lower case and prevent the lower case from shifting in a lateral direction; and a second support provided under the lower case and configured to support a second side of the lower case and prevent the lower case from shifting in the lateral direction.

14. The cooking appliance of claim 13, wherein the first support includes:

a support flange coupled to a bottom panel of the main body;

a support panel connected to the support flange to support the bottom surface of the lower case from below at a position spaced upwardly from the bottom panel; and stoppers configured to protrude upward from the support panel to interfere with a side of the opening of the lower case positioned at the set position.

15. The cooking appliance of claim 13, wherein the second support includes:

a support flange coupled to the bottom panel;

a connecting plate configured to extend upward from the support flange;

a support panel that extends from the connecting plate in an inserting direction of the lower case and is configured to support the bottom surface of the lower case from below at a set position spaced upwardly from the bottom panel; and a stopper configured to protrude upward from the support panel to interfere with a side portion of the lower case facing the opening portion located at the set position.

* * * * *